US012422181B2

(12) United States Patent
Lee et al.

(10) Patent No.: US 12,422,181 B2
(45) Date of Patent: Sep. 23, 2025

(54) MODULE REFRIGERATOR

(71) Applicant: SAMSUNG ELECTRONICS CO., LTD., Suwon-si (KR)

(72) Inventors: Jisook Lee, Suwon-si (KR); Changhyun Kim, Suwon-si (KR); Hyunjoo Kim, Suwon-si (KR); Hosang Park, Suwon-si (KR); Eungryeol Seo, Suwon-si (KR); Wonjae Yoon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 441 days.

(21) Appl. No.: 17/970,947

(22) Filed: Oct. 21, 2022

(65) Prior Publication Data

US 2023/0038735 A1 Feb. 9, 2023

Related U.S. Application Data

(63) Continuation of application No. PCT/KR2021/001689, filed on Feb. 9, 2021.

(30) Foreign Application Priority Data

Apr. 22, 2020 (KR) ..... 10-2020-0048619

(51) Int. Cl.
*F25D 17/08* (2006.01)
*F25D 17/06* (2006.01)
(Continued)

(52) U.S. Cl.
CPC ..... *F25D 17/08* (2013.01); *F25D 23/065* (2013.01)

(58) Field of Classification Search
CPC ..... F25D 23/10; F25D 17/08; F25D 2400/14; F25D 2400/16; F25D 2500/02
See application file for complete search history.

(56) References Cited

U.S. PATENT DOCUMENTS 8,020,401 B2 9/2011 Chen
8,336,322 B2 * 12/2012 Cur ..... F25D 17/02 62/185

FOREIGN PATENT DOCUMENTS

CN 204063741 U 12/2014
CN 108826794 A 11/2018
(Continued)

OTHER PUBLICATIONS

International Search Report dated May 28, 2021, issued in International Application No. PCT/KR2021/001689.
(Continued)

*Primary Examiner* — Steven S Anderson, II
(74) *Attorney, Agent, or Firm* — STAAS & HALSEY LLP

(57) ABSTRACT

A modular refrigerator including a main cabinet, and a sub-cabinet selectively coupleable to a right side, an upper side, and a left side, of the main cabinet. The main cabinet includes a cooling unit, a first connection duct for cold air generated by the cooling unit to flow toward the right side, a second connection duct for the cold air to flow toward the upper side, and a third connection duct for the cold air to flow toward the left side. The sub-cabinet includes a first branch duct that, when the sub-cabinet is coupled to the right side, communicates with the first connection duct, a second branch duct that, when the sub-cabinet is coupled to the upper side, communicates with the second connection duct, and a third branch duct that, when the sub-cabinet is coupled to the left side, communicates with third connection duct.

15 Claims, 25 Drawing Sheets

(51) Int. Cl.
*F25D 19/02* (2006.01)
*F25D 23/06* (2006.01)

(56) References Cited

FOREIGN PATENT DOCUMENTS

| | | | | |
|---|---|---|---|---|
| JP | 2005-42937 | | | 2/2005 |
| JP | 2005042937 | A | * | 2/2005 |
| KR | 10-1998-0010284 | | | 4/1998 |
| KR | 20-0157342 | | | 9/1999 |
| KR | 2002-0013632 | | | 2/2002 |
| KR | 10-2012-0000642 | | | 1/2012 |
| KR | 10-1680382 | | | 11/2016 |

OTHER PUBLICATIONS

Written Opinion dated May 28, 2021, issued in International Application No. PCT/KR2021/001689.

* cited by examiner 20
20
20

MODULE REFRIGERATOR

CROSS-REFERENCE TO RELATED APPLICATIONS

This application is a continuation application, filed under 35 USC 111(a), of International Application PCT/KR2021/001689, filed Feb. 9, 2021, and claims foreign priority to Korean application 10-2020-0048619, filed Apr. 22, 2020.

BACKGROUND

1. Field

Various embodiment of the disclosure relate to a modular refrigerator in which a refrigerator is selectable and installable according to a living space of a consumer.

2. Description of Related Art

In general, a refrigerator is a home appliance which includes a main body having a storage compartment, a cold air supply device provided to supply cold air to the storage compartment, and a door provided to open or close the storage compartment, thereby keeping food fresh.

A modular refrigerator is a refrigerator of which a position can be selected by a consumer to install the refrigerator according to a living space of the consumer.

A modular refrigerator includes cabinets forming storage compartments, and the cabinets include a main cabinet which includes a cooling unit configured to generate cold air and a plurality of sub-cabinets which do not include a cooling unit. The sub-cabinet coupled to the main cabinet is positioned according to a consumer's choice. Cold air generated in the cooling unit of the main cabinet is supplied to the sub-cabinet through a duct.

However, since a position of the duct for supplying cold air from the main cabinet to the sub-cabinet is fixed according to a position at which the sub-cabinet is coupled, there is a problem in that, even though a consumer wants to change the position of the sub-cabinet, the position cannot be changed once the sub-cabinet is installed.

SUMMARY

Aspects of embodiments of the disclosure will be set forth in part in the description which follows and, in part, will be apparent from the description, or may be learned by practice of the presented embodiments.

According to various embodiments of the disclosure, a modular refrigerator may include: a main cabinet including a cooling unit configured to generate cold air, and a connection duct that includes a first connection duct for cold air generated by the cooling unit to flow toward a right side of the main cabinet, a second connection duct for cold air generated by the cooling unit to flow toward an upper side of the main cabinet, and a third connection duct for cold air generated by the cooling unit to flow toward a left side of the main cabinet; and a sub-cabinet that is selectively coupleable to the right side of the main cabinet, the upper side of the main cabinet, and the left side of the main cabinet, and including a cold air supply duct, wherein the cold air supply duct includes a branch duct that branches into: a first branch duct that, when the sub-cabinet is coupled to the right side of the main cabinet, communicates with the first connection duct to receive cold air generated by the cooling unit, a second branch duct that, when the sub-cabinet is coupled to the upper side of the main cabinet, communicates with the second connection duct to receive cold air generated by the cooling unit, and a third branch duct that, when the sub-cabinet is coupled to the left side of the main cabinet, communicates with third connection duct to receive cold air generated by the cooling unit.

According to various embodiments of the disclosure, the cold air supply duct may include a main duct above the branch duct, and a cold air discharge duct connected to an upper portion of the main duct, so that cold air generated by the cooling unit is flowable through the branch duct, then through the main duct, and then through the cold air discharge duct to be discharged to a storage compartment inside the sub-cabinet.

According to various embodiments of the disclosure, the first branch duct branches off from the main duct in a left direction of the sub-cabinet, the second branch duct branches off from the main duct in a lower direction of the sub-cabinet, and the third branch duct branches off from the main duct in a right direction of the sub-cabinet.

According to various embodiments of the disclosure, the main cabinet may include a connection duct extending from the cooling unit and connected to the branch duct, and the connection duct may include a first connection duct extending in a right direction from the cooling unit, a second connection duct extending in an upper direction from the cooling unit, and a third connection duct extending in a left direction from the cooling unit.

According to various embodiments of the disclosure, when the sub-cabinet is coupled to the right side of the main cabinet, the first connection duct and the first branch duct are connected so that cold air generated by the cooling unit is supplied to the sub-cabinet.

According to various embodiments of the disclosure, when the sub-cabinet is coupled to the upper side of the main cabinet, the second connection duct and the second branch duct are connected so that cold air generated by the cooling unit is supplied to the sub-cabinet.

According to various embodiments of the disclosure, when the sub-cabinet is coupled to the left side of the main cabinet, the third connection duct and the third branch duct are connected so that cold air generated by the cooling unit is supplied to the sub-cabinet.

According to various embodiments of the disclosure, the main duct may include a damper configured to adjust a flow rate of cold air generated by the cooling unit and flowing through the main duct.

According to various embodiments of the disclosure, the main duct may include a fan between the damper and the cold air discharge duct, the fan configured to increase an air volume of cold air generated by the cooling unit and flowing through the main duct.

According to various embodiments of the disclosure, the main duct may include a fan between the damper and the branch duct, the fan configured to increase an air volume of cold air generated by the cooling unit and flowing through the main duct.

According to various embodiments of the disclosure, the cold air discharge duct may include a cold air outlet, and the sub-cabinet may include a cold air discharge hole formed at a position corresponding to a position of the cold air outlet, so that cold air flowing through the cold air discharge duct is discharged from the cold air discharge duct through the cold air outlet and then through the cold air discharge hole into the storage compartment.

According to various embodiments of the disclosure, the sub-cabinet may include a cold air collection duct to collect cold air from the storage compartment and guide the collected cold air to the cooling unit.

According to various embodiments of the disclosure, the cold air collection duct may include: a cold air collection hole through which the cold air from the storage compartment is collected, and a guide duct which guides the cold air collected through the cold air collection hole toward the cooling unit, and the guide duct may include: a first guide duct which branches off in a left direction of the sub-cabinet so that, when the sub-cabinet is coupled to the right side of the main cabinet, the first guide duct guides the cold air collected through the cold air collection hole toward the cooling unit, a second guide duct which branches off in a lower direction of the sub-cabinet so that, when the sub-cabinet is coupled to the upper side of the main cabinet, the second guide duct guides the cold air collected through the cold air collection hole toward the cooling unit, and a third guide duct which branches off in a right direction of the sub-cabinet so that, when the sub-cabinet is coupled to the left side of the main cabinet, the third guide duct guides the cold air collected through the cold air collection hole toward the cooling unit.

According to various embodiments of the disclosure, the main cabinet may include an extension duct extending from a communication hole of the cooling unit and connected to the guide duct, and the extension duct may include: a first extension duct extending in a right direction from the cooling unit and, when the sub-cabinet is coupled to the right side of the main cabinet, connects to the first guide duct of the sub-cabinet, a second extension duct extending in an upper direction from the cooling unit and, when the sub-cabinet is coupled to the upper side of the main cabinet, connects to the second guide duct of the sub-cabinet, and a third extension duct extending in a left direction from the cooling unit and, when the sub-cabinet is coupled to the left side of the main cabinet, connects to the third guide duct of the sub-cabinet.

According to various embodiments of the disclosure, the modular refrigerator may include caps configured to, when the sub-cabinet is coupled to one of the right side of the main body, the upper side of the body, and the left side of the main body, seal portions of the branch duct and the connection duct not connected to each other and portions of the guide duct and the extension duct not connected to each other, to prevent a leakage of cold air.

BRIEF DESCRIPTION OF THE DRAWINGS

Aspects, features, and advantages of various embodiments of the disclosure will be more apparent from the following description taken in conjunction with the accompanying drawings, in which.

DETAILED DESCRIPTION

Figure 1:
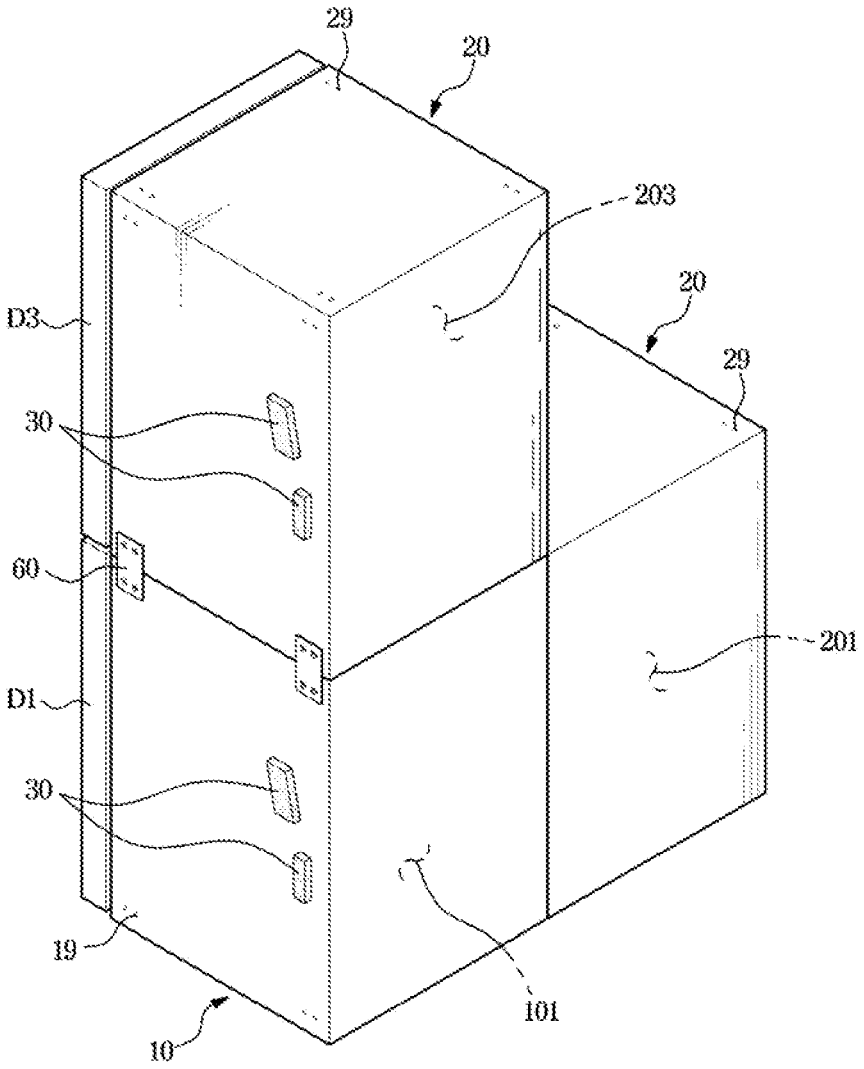
FIG. 1 is a perspective view illustrating an exterior of a modular refrigerator according to an embodiment of the disclosure.

Embodiments described in the present disclosure and configurations shown in the drawings are merely examples of various embodiments and may be modified in various different ways at the time of filing of the present application to replace the embodiments and drawings of the present disclosure.

In addition, the same reference numerals or signs shown in the drawings of the present specification indicate elements or components performing substantially the same function.

Also, the terms used herein are used to describe embodiments and are not intended to limit and/or restrict the disclosed embodiments. A singular expression includes a plural expression unless the context clearly indicates otherwise. In the present specification, the terms "including," "having," and the like are used to specify features, numbers, steps, operations, elements, components, or combinations thereof but do not preclude the presence or addition of one or more of the features, elements, steps, operations, elements, components, or combinations thereof.

While terms including ordinal numbers, such as "first," "second," and the like may be used to describe various components, such components are not limited by the above terms. The above terms are used only to distinguish one component from another component. For example, without departing from the scope of the disclosure, a first component may be referred to as a second component, and likewise a second component may be referred to as a first component. The term "and/or" includes any one or all combinations of a plurality of associated listed items.

In the following detailed description, the terms "front end," "rear end," "upper portion," "lower portion," "front surface," "rear surface," "upper end," "lower end," and the like may be defined by the drawings, but the shape and position of the component is not limited by the terms.

Hereinafter, embodiments according to the disclosure will be described in detail with reference to the accompanying drawings.

Right, upper, and left sides of a first outer box and a main cabinet are based on the directions shown in FIG. 1 illustrating a rear surface of a modular refrigerator.

Various embodiments of the disclosure are directed to providing a modular refrigerator in which a position of a sub-cabinet coupled to a main cabinet is changeable according to a consumer's choice.

According to various embodiments of the disclosure, it is possible to freely change a position of a sub-cabinet to use the sub-cabinet according to a consumer's choice.

In addition, according to various embodiments of the disclosure, irrespective of a position of sub-cabinets, a cold air supply path is the same, thereby maintaining an even temperature distribution inside the sub-cabinets. FIG. 1 is a perspective view illustrating an exterior of the modular refrigerator according to an embodiment of the disclosure.

As shown in FIG. 1, the modular refrigerator may include a first outer box 10 (e.g., a main cabinet) including a first storage compartment 101 formed therein, second outer boxes (e.g., sub-cabinets) 20 coupled to a right side and an upper side of the first outer box 10 and including a second storage compartment 201 and a third storage compartment 203 formed therein, a first door D1 for opening or closing the first storage compartment 101, a second door (not shown) for opening or closing the second storage compartment 201, and a third door D3 for opening or closing the third storage compartment 203.

Although the second outer boxes 20 are illustrated in the drawing as being coupled to the right side and the upper side of the first outer box 10, embodiments are not limited thereto. That is, the second outer boxes 20 may be coupled to right and left sides of the first outer box 10 or may be coupled to left and upper sides thereof. In addition, the second outer boxes 20 may be coupled to the right, upper, and left sides of the first outer box 10. In this case, a fourth storage compartment (not shown) may be formed inside the second outer box 20 coupled to the left side of the first outer box 10. The fourth storage compartment may be opened or closed by a fourth door (not shown).

Accordingly, a respective outer box (e.g. a sub-cabinet) 20 is selectively coupleable to the right side of first outer box (e.g., a main cabinet) 10, the upper side of the first box 10, and the left side of the first box 10. For example, in one configuration, a respective outer box 20 might be connected to the right side of the first box 10. In another configuration, the respective outer box 20 might be connected to the upper side of the first box 10. In still another configuration, the respective outer box 20 might be connected to the left side of the first box 10.

The first outer box 10 and the plurality of second outer boxes 20 may be coupled to each other through brackets 60. This will be described in detail below.

Figure 2:
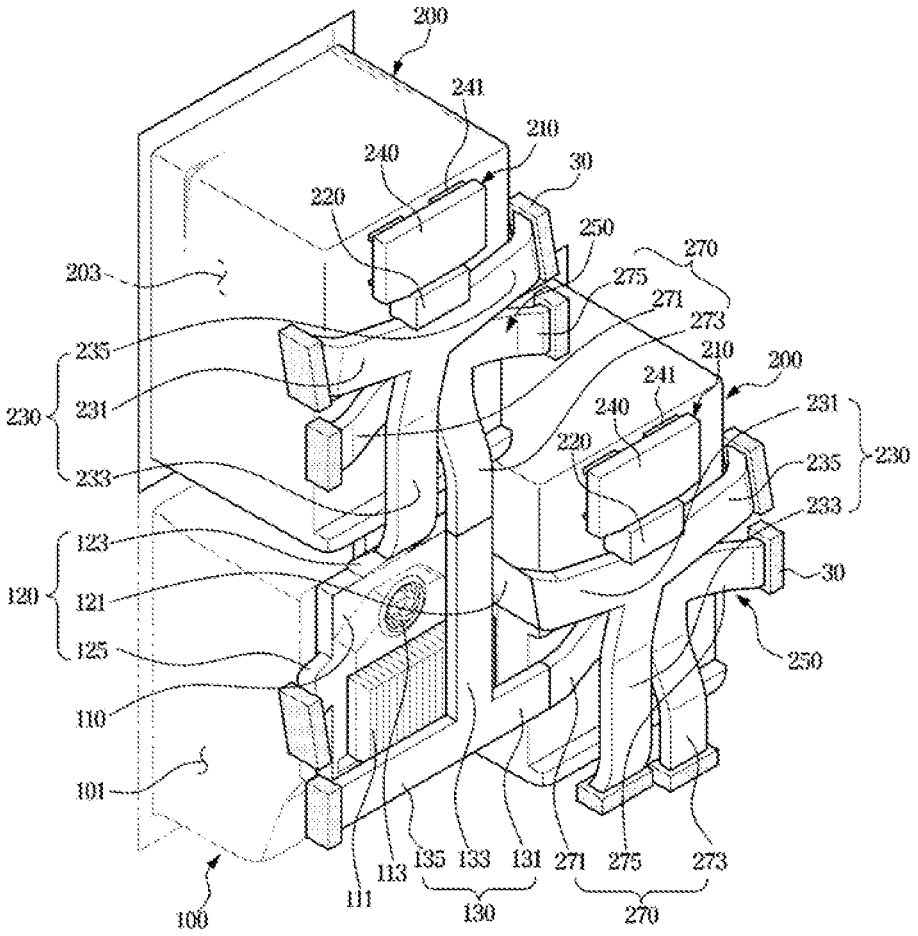
FIG. 2 is a view illustrating a state in which sub-cabinets are coupled to a right side and an upper side of a main cabinet of a modular refrigerator according to an embodiment of the disclosure.
Figure 3:
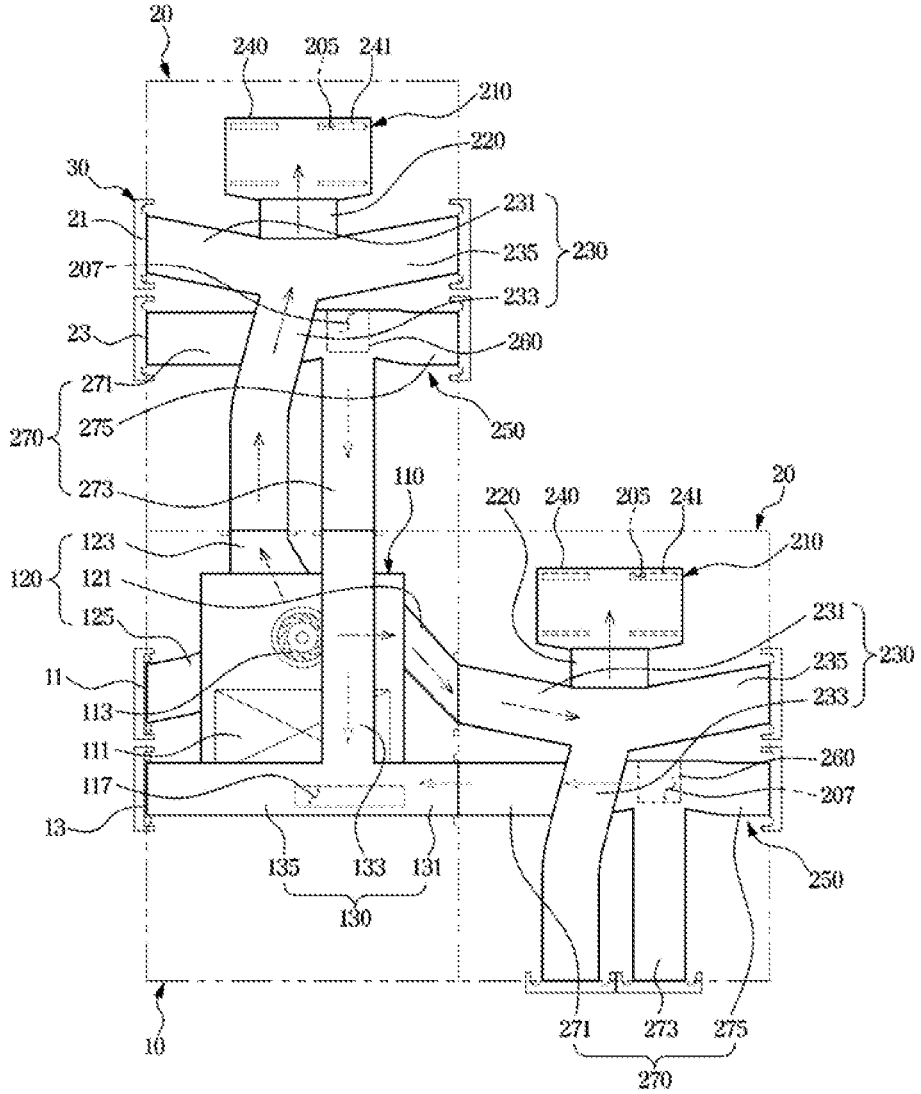
FIG. 3 is a rear view illustrating a state in which the sub-cabinets are coupled to the right side and then upper side of a main cabinet of the modular refrigerator according to an embodiment of the disclosure.
Figure 4:
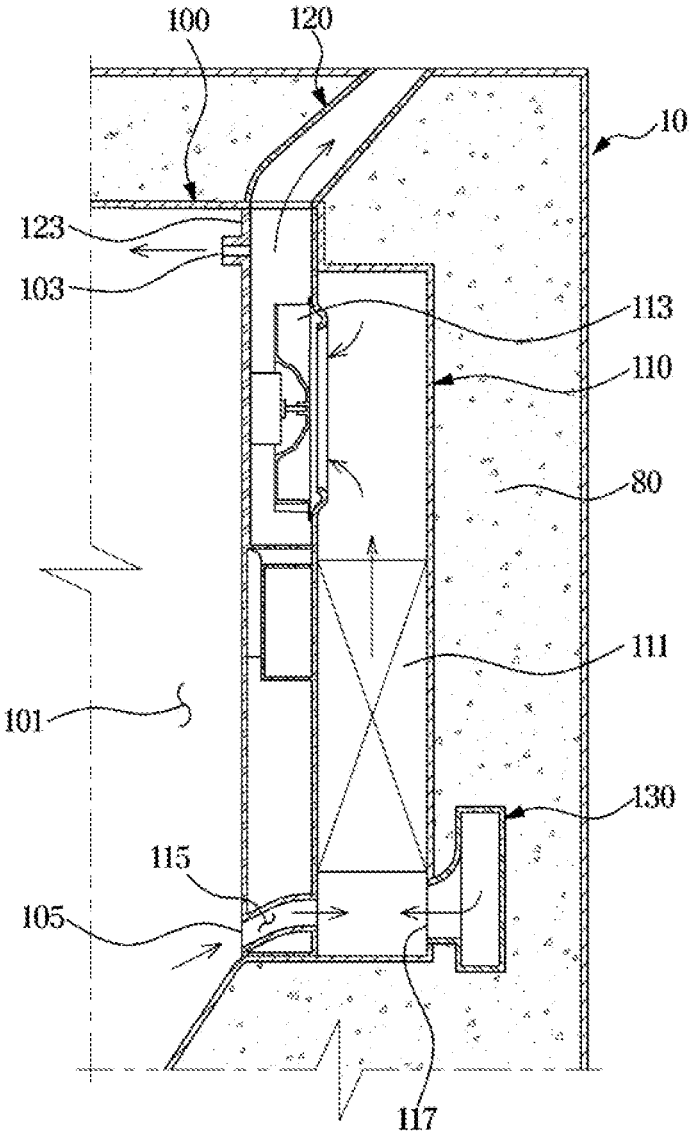
FIG. 4 is a view illustrating a flow of cold air along which the cold air generated in a cooling unit is supplied to a storage compartment to cool the storage compartment and returns to and is collected in the cooling unit.

FIG. 2 is a view illustrating a state in which sub-cabinets are coupled to a right side and an upper side of a main cabinet of a modular refrigerator according to an embodiment of the disclosure. FIG. 3 is a rear view illustrating a state in which the sub-cabinets are coupled to the right side and the upper side of the main cabinet of the modular refrigerator according to an embodiment of the disclosure. FIG. 4 is a view illustrating a flow of cold air along which the cold air generated in a cooling unit is supplied to a storage compartment to cool the storage compartment and returns to and is collected in the cooling unit.

As shown in FIGS. 2 to 4, cabinets 100 and 200 may include a main cabinet 100 and a plurality of sub-cabinets 200 detachably coupled to the main cabinet 100.

A first storage compartment 101 may be formed inside the main cabinet 100. A first outer box 10 may be coupled to an outer side of the main cabinet 100 (see FIG. 1). A cooling unit 110 for generating cold air may be provided on a rear surface of the main cabinet 100. The cooling unit 110 may include an evaporator 111 for generating cold air and a blowing fan 113 for guiding the cold air generated by the evaporator 111 to each of storage compartments 101, 201, and 203. In addition, the cooling unit 110 may include a cold air suction hole 115 through which cold air is suctioned into the cooling unit 110 from the first storage compartment 101 and a communication hole 117 which communicates with an extension duct 130. A portion of the cold air generated by the cooling unit 110 may be supplied into the first storage compartment 101 through a cold air discharge hole 103 formed in an upper end portion of the rear surface of the main cabinet 100. The cold air supplied into the first storage compartment 101 may cool the first storage compartment 101, and then, in a state in which a temperature thereof is increased, the cold air may be collected into the cooling unit 110 through the cold air suction hole 115 formed in the cooling unit 110. The cold air collected into the cooling unit 110 may exchange heat with the evaporator 111 again, and in a state in which a temperature thereof is decreased, the cold air may be supplied to the first storage compartment 101 inside the main cabinet 100 and the storage compartments 201 and 203 inside the sub-cabinets 200.

The main cabinet 100 may include a connection duct 120 which extends from the cooling unit 110 and is connected to a branch duct 230 of a cold air supply duct 210 to be described below and the extension duct 130 which extends from the cooling unit 110 and is connected to a guide duct 270 of a cold air collection duct 250 to be described below. The remaining portion of the cold air generated by the cooling unit 110 may be supplied to the sub-cabinet 200 through the connection duct 120. The connection duct 120 and the extension duct 130 will be described in detail below.

The plurality of sub-cabinets 200 may be detachably coupled to left, right, and upper sides of the main cabinet 100 according to a consumer's choice. The plurality of sub-cabinets 200 may include the sub-cabinet 200 coupled to the left side of the main cabinet 100 to form a second storage compartment 201 therein and the sub-cabinet 200 coupled to the upper side of the main cabinet 100 to form a third storage compartment 203 therein. Since a cooling unit for generating cold air is not provided in the plurality of sub-cabinets 200, the plurality of sub-cabinets 200 may be coupled to the main cabinet 100 to receive cold air generated by the cooling unit 110 of the main cabinet 100. Each of the plurality of sub-cabinets 200 may include the cold air supply duct 210 provided on a rear surface thereof to receive cold air from the cooling unit 110.

In order to receive cold air from the cooling unit 110 irrespective of whether each of the plurality of sub-cabinets 200 is coupled to any portion of the left, right, and upper sides of the main cabinet 100, the cold air supply duct 210 may branch off to have three flow paths. The cold air supply duct 210 may include a main duct 220, the branch duct 230 which branches off to have three flow paths below the main duct 220, and a cold air discharge duct 240 which is connected to an upper portion of the main duct 220 and discharges the cold air supplied from the cooling unit 110 to the storage compartment 201 or 203 inside the sub-cabinet 200.

The main duct 220 may include a damper 221 which controls a flow rate of cold air supplied from the cooling unit 110. In addition, the main duct 220 may further include a fan 223 which increases an air volume of cold air supplied from the cooling unit 110 (see FIGS. 10 and 11).

The branch duct 230 may include a first branch duct 231 which branches off from the main duct 220 in a left direction of the sub-cabinet 200, a second branch duct 233 which branches off from the main duct 220 in a lower direction of the sub-cabinet 200, and a third branch duct 235 which branches off from the main duct 220 in a right direction of the sub-cabinet 200. Since the branch duct 230 branches off to have three flow paths, even when each of the plurality of sub-cabinets 200 is coupled to any portion of the left, right, and upper sides of the main cabinet 100, the branch duct 230 may be connected to the connection duct 120, which extends from the cooling unit 110 of the main cabinet 100 in three directions, to receive cold air from the cooling unit 110. That is, each of the plurality of sub-cabinets 200 may be coupled to any portion of the left, right, and upper sides of the main cabinet 100 according to a consumer's choice. The connection between the branch duct 230 and the connection duct 120 when the sub-cabinet 200 is coupled to the main cabinet 100 will be described in detail below.

The cold air discharge duct 240 may include a plurality of cold air outlets 241 for discharging cold air to the storage compartment 201 or 203 inside the sub-cabinet 200. The sub-cabinet 200 may include a plurality of cold air discharge holes 205 formed at positions corresponding to the cold air outlets 241. Cold air discharged through the plurality of cold air outlets 241 may be discharged into the storage compartment 201 or 203 through the plurality of cold air discharge holes 205.

The main cabinet 100 may include the connection duct 120 which extends from the cooling unit 110 and is connected to the branch duct 230 of the cold air supply duct 210. The connection duct 120 may include a first connection duct 121 which extends in a right direction from the cooling unit 110, a second connection duct 123 which extends in an upper direction from the cooling unit 110, and a third connection duct 125 which extends in a left direction from the cooling unit 110.

Since the branch duct 230 having three flow paths is provided in each of the plurality of sub-cabinets 200 and the connection duct 120 branching off into three ducts is provided in the main cabinet 100, even when the sub-cabinet 200 is coupled to any portion of the right, upper, and left sides of the main cabinet 100, a supply path of cold air is the same. Thus, the storage compartments 201 and 203 inside the plurality of sub-cabinets 200 receiving cold air from the cooling unit 110 may have an even temperature distribution.

The plurality of sub-cabinets 200 may be coupled to the right side and the upper side of the main cabinet 100. When the sub-cabinet 200 is coupled to the right side of the main cabinet 100, the first connection duct 121 of the main cabinet 100 and the first branch duct 231 of the sub-cabinet 200 may be connected. Thus, cold air generated by the cooling unit 110 may be supplied to the sub-cabinet 200 through the first connection duct 121 and the first branch duct 231. The cold air supplied to the sub-cabinet 200 through the first branch duct 231 may be supplied to the second storage compartment 201 inside the sub-cabinet 200 through the cold air outlet 241 of the cold air discharge duct 240 and the cold air discharge hole 205 of the sub-cabinet 200. In this case, ends of the third connection duct 125, the second branch duct 233, and the third branch duct 235, which are not used as a supply path of cold air, may be sealed by caps 30 to prevent a leakage of cold air. A first outer box 10 coupled to an outer side of the main cabinet 100 may include three first connectors 11 at which ends of the connection duct 120 are exposed to the outside. The first connection duct 121 of the main cabinet 100 and the first branch duct 231 of the sub-cabinet 200 may be connected through the first connector 11. The cap 30 may be coupled to the first outer box 10 to seal the end of the third connection duct 125 exposed to the outside through the first connector 11. A second outer box 20 coupled to an outer side of the sub-cabinet 200 may include three second connectors 21 at which ends of the branch duct 230 are exposed to the outside. The first connection duct 121 of the main cabinet 100 and the first branch duct 231 of the sub-cabinet 200 may be connected through the second connector 21. That is, the first connection duct 121 of the main cabinet 100 and the first branch duct 231 of the sub-cabinet 200 may be connected through the first connector 11 and the second connector 21. The caps 30 may be coupled to the second outer box 20 to seal the ends of the second branch duct 233 and the third branch duct 235 exposed to the outside through the second connectors 21. A detailed configuration in which the caps 30 are coupled to the first outer box 10 and the second outer box 20 will be described below. Cold air supplied to the second storage compartment 201 may cool the second storage compartment 201, and then, in a state in which a temperature thereof is increased, the cold air may be moved to the cold air collection duct 250 through a cold air discharge hole 207 formed in a rear surface of the sub-cabinet 200. The cold air moved to the cold air collection duct 250 may be moved to the extension duct 130 of the main cabinet 100. The cold air moved to the extension duct 130 may be collected into the cooling unit 110 through the communication hole 117 formed in the cooling unit 110. The cold air collected into the cooling unit 110 may exchange heat with the evaporator 111 again, and in a state in which a temperature thereof is decreased, the cold air may be supplied to the first storage compartment 101 inside the main cabinet 100 and the second storage compartment 201 inside the sub-cabinet 200.

When the sub-cabinet 200 is coupled to the upper side of the main cabinet 100, the second connection duct 123 of the main cabinet 100 and the second branch duct 233 of the sub-cabinet 200 may be connected. Thus, cold air generated by the cooling unit 110 may be supplied to the sub-cabinet 200 through the second connection duct 123 and the second branch duct 233. The cold air supplied to the sub-cabinet 200 through the second branch duct 233 may be supplied to the third storage compartment 203 inside the sub-cabinet 200 through the cold air outlet 241 of the cold air discharge duct 240 and the cold air discharge hole 205 of the sub-cabinet 200. In this case, ends of the third connection duct 125, the first branch duct 231, and the third branch duct 235, which are not used as a supply path of cold air, may be sealed by the caps 30 to prevent a leakage of cold air. The first outer box 10 coupled to the outer side of the main cabinet 100 may include three first connectors 11 at which the ends of the connection duct 120 are exposed to the outside. The second connection duct 123 of the main cabinet 100 and the second branch duct 233 of the sub-cabinet 200 may be connected through the first connector 11. The cap 30 may be coupled to the first outer box 10 to seal the end of the third connection duct 125 exposed to the outside through the first connector 11. The second outer box 20 coupled to the outer side of the sub-cabinet 200 may include three second connectors 21 at which the ends of the branch duct 230 are exposed to the outside. The second connection duct 123 of the main cabinet 100 and the second branch duct 233 of the sub-cabinet 200 may be connected through the second connector 21. That is, the second connection duct 123 of the main cabinet 100 and the second branch duct 233 of the sub-cabinet 200 may be connected through the first connector 11 and the second connector 21. The caps 30 may be coupled to the second outer box 20 to seal the ends of the first branch duct 231 and the third branch duct 235 exposed to the outside through the second connectors 21. A detailed configuration in which the caps 30 are coupled to the first outer box 10 and the second outer box 20 will be described below. Cold air supplied to the third storage compartment 203 may cool the third storage compartment 203, and then, in a state in which a temperature thereof is increased, the cold air may be moved to the cold air collection duct 250 through the cold air discharge hole 207 formed in the rear surface of the sub-cabinet 200. The cold air moved to the cold air collection duct 250 may be moved to the extension duct 130 of the main cabinet 100. The cold air moved to the extension duct 130 may be collected into the cooling unit 110 through the communication hole 117 formed in the cooling unit 110. The cold air collected into the cooling unit 110 may exchange heat with the evaporator 111 again, and in a state in which a temperature thereof is decreased, the cold air may be supplied to the first storage compartment 101 inside the main cabinet 100 and the second storage compartment 201 inside the sub-cabinet 200.

Each of the plurality of sub-cabinets 200 may include the cold air collection duct 250 which allows cold air supplied to the sub-cabinet 200 through the cold air supply duct 210 to be collected into the cooling unit 110 in a state in which a temperature thereof is increased after the cold air cools the storage compartment 201 or 203.

In order for cold air cooling the storage compartment 201 or 203 to be collected into the cooling unit 110 irrespective of whether each of the plurality of sub-cabinets 200 is coupled to any portion of the left, right, and upper sides of the main cabinet 100, the cold air collection duct 250 may branch off to have three flow paths. The cold air collection duct 250 may include a cold air collection hole 260 through which cold air is collected from the storage compartment 201 or 203 and a guide duct 270 which guides the cold air collected through the cold air collection hole 260 to the cooling unit 110.

The guide duct 270 may include a first guide duct 271 which branches off to guide the cold air collected through the cold air collection hole 260 in the left direction of the sub-cabinet 200, a second guide duct 273 which branches off to guide the cold air collected through the cold air collection hole 260 in the lower direction of the sub-cabinet 200, and a third guide duct 275 which branches off to guide the cold air collected through the cold air collection hole 260 in the right direction of the sub-cabinet 200.

Since the guide duct 270 branches off to have three flow paths, the guide duct 270 may be connected to the extension duct 130, which extends from the cooling unit 110 of the main cabinet 100 in three directions, to allow cold air to be collected into the cooling unit 110 even when each of the plurality of sub-cabinets 200 is coupled to any portion of the left, right, and upper sides of the main cabinet 100.

The main cabinet 100 may further include the extension duct 130 which extends from the cooling unit 110 and is connected to the guide duct 270 of the cold air collection duct 250. The extension duct 130 may include a first extension duct 131 which extends in the right direction from the cooling unit 110, a second extension duct 133 which extends in the upper direction from the cooling unit 110, and a third extension duct 135 which extends in the left direction from the cooling unit 110.

The plurality of sub-cabinets 200 may be coupled to the right side and the upper side of the main cabinet 100. When a sub-cabinet 200 is coupled to the right side of the main cabinet 100, the first extension duct 131 of the main cabinet 100 and the first guide duct 271 of the sub-cabinet 200 may be connected. Thus, cold air cooling the second storage compartment 201 may be moved to the first guide duct 271 through the cold air collection hole 260. The cold air guided to the first guide duct 271 may be moved to the first extension duct 131 connected to the first guide duct 271 to be collected into the cooling unit 110. The cold air moved to the first extension duct 131 may be collected into the cooling unit 110 through the communication hole 117 formed in the cooling unit 110. The cold air collected into the cooling unit 110 may exchange heat with the evaporator 111 again, and in a state in which a temperature thereof is decreased, the cold air may be supplied to the first storage compartment 101 inside the main cabinet 100 and the second storage compartment 201 inside the sub-cabinet 200. In this case, ends of the third extension duct 135, the second guide duct 273, and the third guide duct 275, which are not used as a supply path of cold air, may be sealed by the caps 30 to prevent a leakage of cold air. The first outer box 10 coupled to the outer side of the main cabinet 100 may include three third connectors 13 at which ends of the extension duct 130 are exposed to the outside. The first extension duct 131 of the main cabinet 100 and the first guide duct 271 of the sub-cabinet 200 may be connected through the third connector 13. The cap 30 may be coupled to the first outer box 10 to seal the end of the third extension duct 135 exposed to the outside through the third connector 13. The second outer box 20 coupled to the outer side of the sub-cabinet 200 may include three fourth connectors 23 at which ends of the guide duct 270 are exposed to the outside. The first extension duct 131 of the main cabinet 100 and the first guide duct 271 of the sub-cabinet 200 may be connected through the fourth connector 23. That is, the first extension duct 131 of the main cabinet 100 and the first guide duct 271 of the sub-cabinet 200 may be connected through the third connector 13 and the fourth connector 23. The caps 30 may be coupled to the second outer box 20 to seal the ends of the second guide duct 273 and the third guide duct 275 exposed to the outside through the fourth connectors 23. A detailed configuration in which the caps 30 are coupled to the first outer box 10 and the second outer box 20 will be described below.

When the sub-cabinet 200 is coupled to the upper side of the main cabinet 100, the second extension duct 133 of the main cabinet 100 and the second guide duct 273 of the sub-cabinet 200 may be connected. Thus, cold air cooling the third storage compartment 203 may be moved to the second guide duct 273 through the cold air collection hole 260. The cold air guided to the second guide duct 273 may be moved to the second extension duct 133 connected to the second guide duct 273 to be collected into the cooling unit 110. The cold air moved to the second extension duct 133 may be collected into the cooling unit 110 through the communication hole 117 formed in the cooling unit 110. The cold air collected into the cooling unit 110 may exchange heat with the evaporator 111 again, and in a state in which a temperature thereof is decreased, the cold air may be supplied to the first storage compartment 101 inside the main cabinet 100 and the third storage compartment 203 inside the sub-cabinet 200. In this case, ends of the third extension duct 135, the first guide duct 271, and the third guide duct 275, which are not used as a supply path of cold air, may be sealed by the caps 30 to prevent a leakage of cold air. The first outer box 10 coupled to the outer side of the main cabinet 100 may include three third connectors 13 at which the ends of the extension duct 130 are exposed to the outside. The second extension duct 133 of the main cabinet 100 and the second guide duct 273 of the sub-cabinet 200 may be connected through the third connector 13. The cap 30 may be coupled to the first outer box 10 to seal the end of the third extension duct 135 exposed to the outside through the third connector 13. The second outer box 20 coupled to the outer side of the sub-cabinet 200 may include three fourth connectors 23 at which the ends of the guide duct 270 are exposed to the outside. The second extension duct 133 of the main cabinet 100 and the second guide duct 273 of the sub-cabinet 200 may be connected through the fourth connector 23. That is, the second extension duct 133 of the main cabinet 100 and the second guide duct 273 of the sub-cabinet 200 may be connected through the third connector 13 and the fourth connector 23. The caps 30 may be coupled to the second outer box 20 to seal the ends of the first guide duct 271 and the third guide duct 275 exposed to the outside through the fourth connectors 23. A detailed configuration in which the caps 30 are coupled to the first outer box 10 and the second outer box 20 will be described below.

Figure 5:
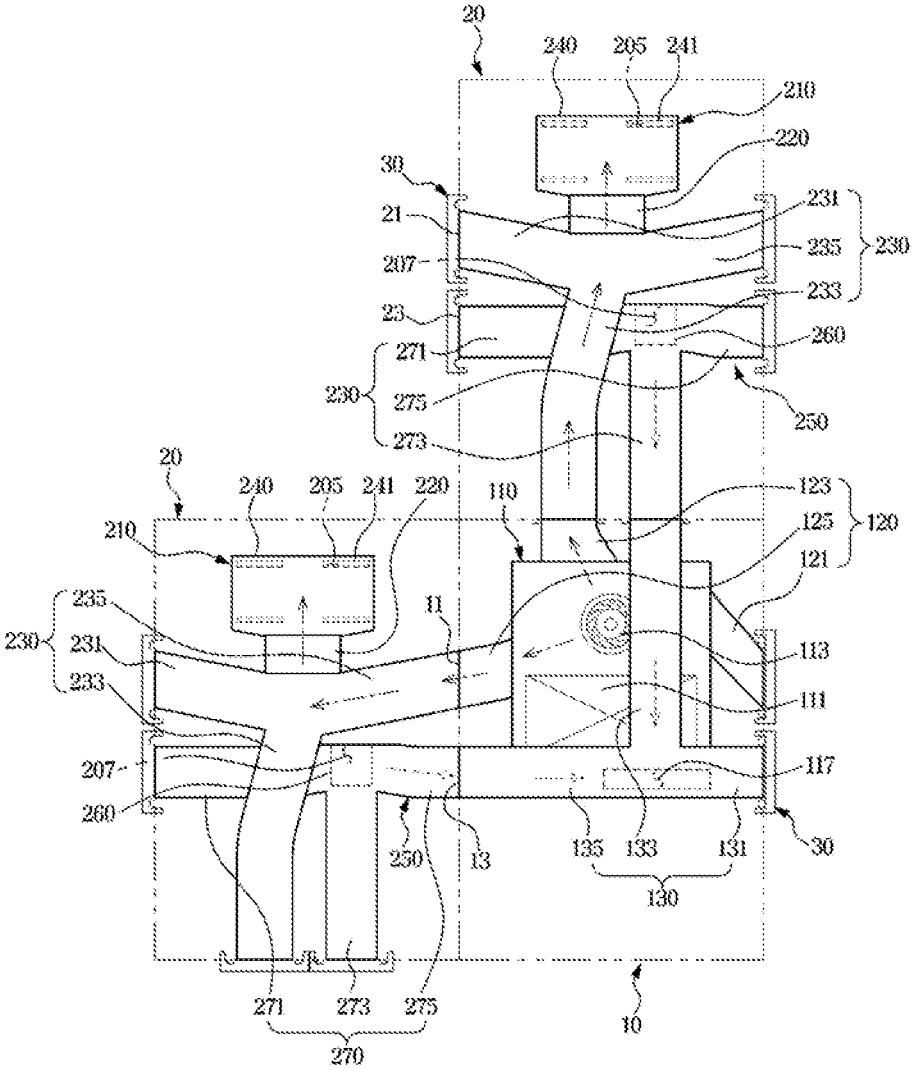
FIG. 5 is a rear view illustrating a state in which sub-cabinets are coupled to an upper side and a left side of a main cabinet of a modular refrigerator according to an embodiment of the disclosure.

FIG. 5 is a rear view illustrating a state in which sub-cabinets are coupled to an upper side and a left side of a main cabinet of a modular refrigerator according to an embodiment of the disclosure.

As shown in FIG. 5, a plurality of sub-cabinets 200 may be coupled to an upper side and a left side of a main cabinet 100. When a sub-cabinet 200 is coupled to the left side of the main cabinet 100, a third connection duct 125 of the main cabinet 100 may be connected to a third branch duct 235 of the sub-cabinet 200. Thus, cold air generated by a cooling unit 110 may be supplied to the sub-cabinet 200 through the third connection duct 125 and the third branch duct 235. The cold air supplied to the sub-cabinet 200 through the third branch duct 235 may be supplied to a fourth storage compartment (not shown) inside the sub-cabinet 200 through a cold air outlet 241 of a cold air discharge duct 240 and a cold air discharge hole 205 of the sub-cabinet 200. In this case, ends of a first connection duct 121, a first branch duct 231, and a second branch duct 233, which are not used as a supply path of cold air, may be sealed by caps 30 to prevent a leakage of cold air. A first outer box 10 coupled to an outer side of the main cabinet 100 may include three first connectors 11 at which ends of a connection duct 120 are exposed to the outside. The third connection duct 125 of the main cabinet 100 and the third branch duct 235 of the sub-cabinet 200 may be connected through the first connector 11. The cap 30 may be coupled to the first outer box 10 to seal the end of the first connection duct 121 exposed to the outside through the first connector 11. A second outer box 20 coupled to an outer side of the sub-cabinet 200 may include three second connectors 21 at which ends of a branch duct 230 are exposed to the outside. The third connection duct 125 of the main cabinet 100 and the third branch duct 235 of the sub-cabinet 200 may be connected through the second connector 21. That is, the third connection duct 125 of the main cabinet 100 and the third branch duct 235 of the sub-cabinet 200 may be connected through the first connector 11 and the second connector 21. The caps 30 may be coupled to the second outer box 20 to seal the ends of the first branch duct 231 and the second branch duct 233 exposed to the outside through the second connectors 21. A detailed configuration in which the caps 30 are coupled to the first outer box 10 and the second outer box 20 will be described below. Cold air supplied to the fourth storage compartment may cool the fourth storage compartment, and then, in a state in which a temperature thereof is increased, the cold air may be moved to a cold air collection duct 250 through a cold air discharge hole 207 formed in a rear surface of the sub-cabinet 200. The cold air moved to the cold air collection duct 250 may be moved to an extension duct 130 of the main cabinet 100. The cold air moved to the extension duct 130 may be collected into the cooling unit 110 through a communication hole 117 formed in the cooling unit 110. The cold air collected into the cooling unit 110 may exchange heat with an evaporator 111 again, and in a state in which a temperature thereof is decreased, the cold air may be supplied to a first storage compartment 101 inside the main cabinet 100 and the fourth storage compartment inside the sub-cabinet 200.

Since a configuration in which the connection duct 120 and the branch duct 230 are connected when the sub-cabinet 200 is coupled to the upper side of the main cabinet 100 is the same as a configuration shown in FIG. 3, descriptions thereof will be omitted.

When a sub-cabinet 200 is coupled to the left side of the main cabinet 100, a third extension duct 135 of the main cabinet 100 and a third guide duct 275 of the sub-cabinet 200 may be connected. Thus, cold air cooling the fourth storage compartment may be moved to the third guide duct 275 through a cold air collection hole 260. The cold air guided to the third guide duct 275 may be moved to the third extension duct 135 connected to the third guide duct 275 to be collected into the cooling unit 110. The cold air moved to the third extension duct 135 may be collected into the cooling unit 110 through the communication hole 117 formed in the cooling unit 110. The cold air collected into the cooling unit 110 may exchange heat with the evaporator 111 again, and in a state in which a temperature thereof is decreased, the cold air may be supplied to the first storage compartment 101 inside the main cabinet 100 and the fourth storage compartment inside the sub-cabinet 200. In this case, ends of a first extension duct 131, a first guide duct 271, and a second guide duct 273, which are not used as a supply path of cold air, may be sealed by the caps 30 to prevent a leakage of cold air. The first outer box 10 coupled to the outer side of the main cabinet 100 may include three third connectors 13 at which ends of the extension duct 130 are exposed to the outside. The third extension duct 135 of the main cabinet 100 and the third guide duct 275 of the sub-cabinet 200 may be connected through the third connector 13. The cap 30 may be coupled to the first outer box 10 to seal the end of the first extension duct 131 exposed to the outside through the third connector 13. The second outer box 20 coupled to the outer side of the sub-cabinet 200 may include three fourth connectors 23 at which ends of a guide duct 270 are exposed to the outside. The third extension duct 135 of the main cabinet 100 and the third guide duct 275 of the sub-cabinet 200 may be connected through the fourth connector 23. That is, the third extension duct 135 of the main cabinet 100 and the third guide duct 275 of the sub-cabinet 200 may be connected through the third connector 13 and the fourth connector 23. The caps 30 may be coupled to the second outer box 20 to seal the ends of the first guide duct 271 and the second guide duct 273 exposed to the outside through the fourth connectors 23. A detailed configuration in which the caps 30 are coupled to the first outer box 10 and the second outer box 20 will be described below.

Since a configuration in which the extension duct 130 and the guide duct 270 are connected when the sub-cabinet 200 is coupled to the upper side of the main cabinet 100 is the same as a configuration shown in FIG. 3, descriptions thereof will be omitted.

Figure 6:
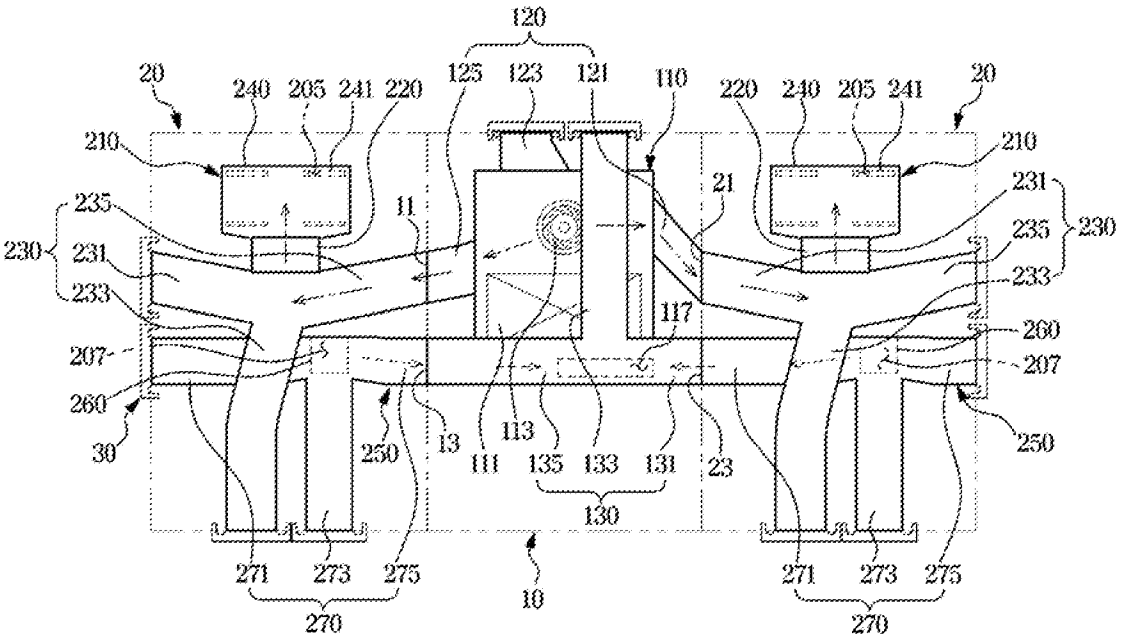
FIG. 6 is a rear view illustrating a state in which sub-cabinets are coupled to a right side and a left side of a main cabinet of a modular refrigerator according to an embodiment of the disclosure.

FIG. 6 is a rear view illustrating a state in which sub-cabinets are coupled to a right side and a left side of a main cabinet of a modular refrigerator according to an embodiment of the disclosure.

As shown in FIG. 6, a plurality of sub-cabinets 200 may be coupled to a right side and a left side of a main cabinet 100. Since a configuration related to a connection between a connection duct 120 and a branch duct 230 and a connection between an extension duct 130 and a guide duct 270 is the same as a configuration in which the sub-cabinet 200 is coupled to the right side of the main cabinet 100 in FIG. 3 and a configuration in which the sub-cabinet 200 is coupled to the left side of the main cabinet 100 in FIG. 5, descriptions thereof will be omitted.

When the sub-cabinet 200 is coupled to the right side of the main cabinet 100, ends of a second connection duct 123, a second branch duct 233, and a third branch duct 235, which are not used as a supply path of cold air, may be sealed by caps 30 to prevent a leakage of cold air. A first outer box 10 coupled to an outer side of the main cabinet 100 may include three first connectors 11 at which ends of the connection duct 120 are exposed to the outside. A first connection duct 121 of the main cabinet 100 and a first branch duct 231 of the sub-cabinet 200 may be connected through the first connector 11. The cap 30 may be coupled to the first outer box 10 to seal the end of the second connection duct 123 exposed to the outside through the first connector 11. A second outer box 20 coupled to an outer side of the sub-cabinet 200 may include three second connectors 21 at which ends of the branch duct 230 are exposed to the outside. The first connection duct 121 of the main cabinet 100 and the first branch duct 231 of the sub-cabinet 200 may be connected through the second connector 21. That is, the first connection duct 121 of the main cabinet 100 and the first branch duct 231 of the sub-cabinet 200 may be connected through the first connector 11 and the second connector 21. The caps 30 may be coupled to the second outer box 20 to seal the ends of the second branch duct 233 and the third branch duct 235 exposed to the outside through the second connectors 21. A detailed configuration in which the caps 30 are coupled to the first outer box 10 and the second outer box 20 will be described below.

When the sub-cabinet 200 is coupled to the right side of the main cabinet 100, ends of a second extension duct 133, a second guide duct 273, and a third guide duct 275, which are not used as a supply path of cold air, may be sealed by the caps 30 to prevent a leakage of cold air. The first outer box 10 coupled to the outer side of the main cabinet 100 may include three third connectors 13 at which ends of the extension duct 130 are exposed to the outside. A first extension duct 131 of the main cabinet 100 and a first guide duct 271 of the sub-cabinet 200 may be connected through the third connector 13. The cap 30 may be coupled to the first outer box 10 to seal the end of the second extension duct 133 exposed to the outside through the third connector 13. The second outer box 20 coupled to the outer side of the sub-cabinet 200 may include three fourth connectors 23 at which ends of the guide duct 270 are exposed to the outside. The first extension duct 131 of the main cabinet 100 and the first guide duct 271 of the sub-cabinet 200 may be connected through the fourth connector 23. That is, the first extension duct 131 of the main cabinet 100 and the first guide duct 271 of the sub-cabinet 200 may be connected through the third connector 13 and the fourth connector 23. The caps 30 may be coupled to the second outer box 20 to seal the ends of the second guide duct 273 and the third guide duct 275 exposed to the outside through the fourth connectors 23. A detailed configuration in which the caps 30 are coupled to the first outer box 10 and the second outer box 20 will be described below.

When the sub-cabinet 200 is coupled to the left side of the main cabinet 100, ends of the second connection duct 123, a first branch duct 231, and a second branch duct 233, which are not used as a supply path of cold air, may be sealed by the caps 30 to prevent a leakage of cold air. The first outer box 10 coupled to the outer side of the main cabinet 100 may include three first connectors 11 at which the ends of the connection duct 120 are exposed to the outside. A third connection duct 125 of the main cabinet 100 and the third branch duct 235 of the sub-cabinet 200 may be connected through the first connector 11. The cap 30 may be coupled to the first outer box 10 to seal the end of the second connection duct 123 exposed to the outside through the first connector 11. The second outer box 20 coupled to the outer side of the sub-cabinet 200 may include three second connectors 21 at which the ends of the branch duct 230 are exposed to the outside. The third connection duct 125 of the main cabinet 100 and the third branch duct 235 of the sub-cabinet 200 may be connected through the second connector 21. That is, the third connection duct 125 of the main cabinet 100 and the third branch duct 235 of the sub-cabinet 200 may be connected through the first connector 11 and the second connector 21. The caps 30 may be coupled to the second outer box 20 to seal the ends of the first branch duct 231 and the second branch duct 233 exposed to the outside through the second connectors 21. A detailed configuration in which the caps 30 are coupled to the first outer box 10 and the second outer box 20 will be described below.

When the sub-cabinet 200 is coupled to the left side of the main cabinet 100, ends of the second extension duct 133, the first guide duct 271, and the second guide duct 273, which are not used as a supply path of cold air, may be sealed by the caps 30 to prevent a leakage of cold air. The first outer box 10 coupled to the outer side of the main cabinet 100 may include three third connectors 13 at which the ends of the extension duct 130 are exposed to the outside. The third extension duct 135 of the main cabinet 100 and the third guide duct 275 of the sub-cabinet 200 may be connected through the third connector 13. The cap 30 may be coupled to the first outer box 10 to seal the end of the second extension duct 133 exposed to the outside through the third connector 13. The second outer box 20 coupled to the outer side of the sub-cabinet 200 may include three fourth connectors 23 at which the ends of the guide duct 270 are exposed to the outside. The third extension duct 135 of the main cabinet 100 and the third guide duct 275 of the sub-cabinet 200 may be connected through the fourth connector 23. That is, the third extension duct 135 of the main cabinet 100 and the third guide duct 275 of the sub-cabinet 200 may be connected through the third connector 13 and the fourth connector 23. The caps 30 may be coupled to the second outer box 20 to seal the ends of the first guide duct 271 and the second guide duct 273 exposed to the outside through the fourth connectors 23. A detailed configuration in which the caps 30 are coupled to the first outer box 10 and the second outer box 20 will be described below.

Figure 7:
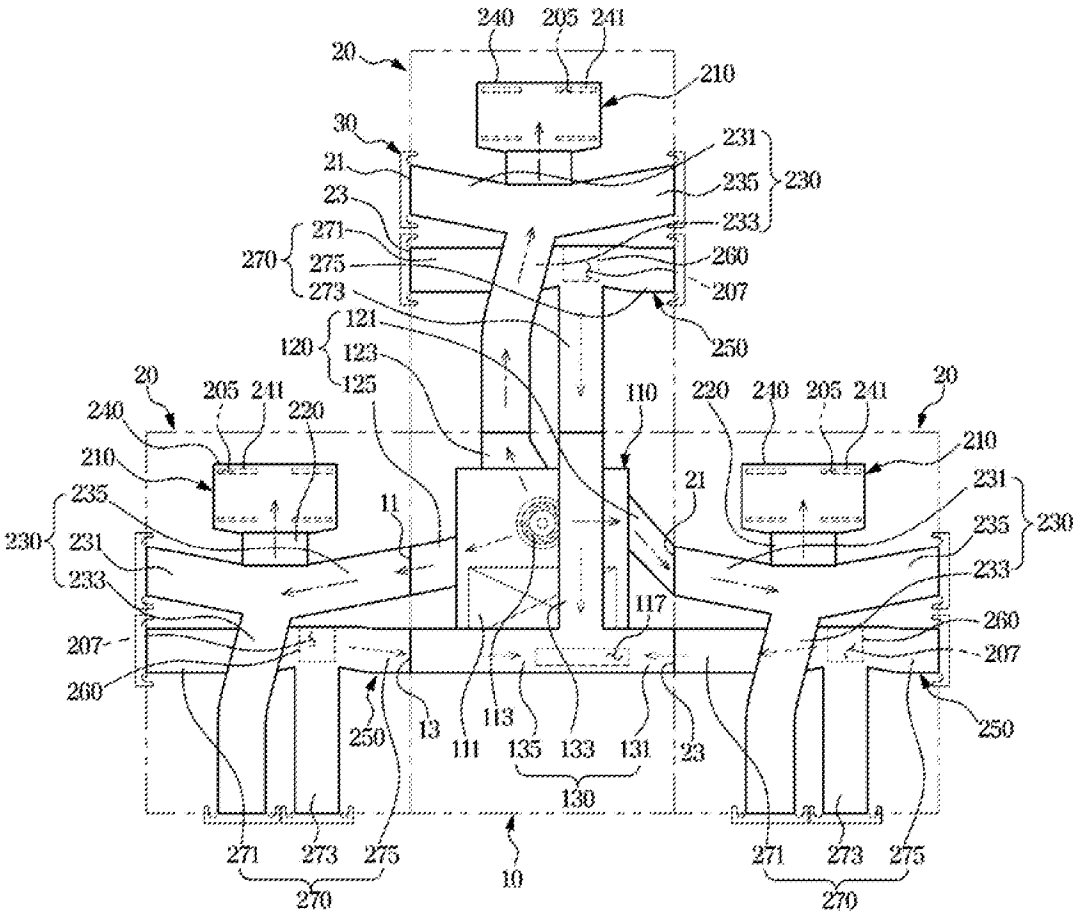
FIG. 7 is a rear view illustrating a state in which sub-cabinets are coupled to a right side, an upper side, and a left side of a main cabinet of a modular refrigerator according to an embodiment of the disclosure.

FIG. 7 is a rear view illustrating a state in which sub-cabinets are coupled to a right side, an upper side, and a left side of a main cabinet of a modular refrigerator according to an embodiment of the disclosure.

As shown in FIG. 7, a plurality of sub-cabinets 200 may be coupled to a right side, an upper side, and a left side of a main cabinet 100. Since a configuration related to a connection between a connection duct 120 and a branch duct 230 and a connection between an extension duct 130 and a guide duct 270 is the same as a configuration in which the sub-cabinets 200 are coupled to the right side and the upper side of the main cabinet 100 in FIG. 3 and a configuration in which the sub-cabinet 200 is coupled to the left side of the main cabinet 100 in FIG. 5, descriptions thereof will be omitted.

When the plurality of sub-cabinet 200 are coupled to all of the right side, the upper side, and the left side of the main cabinet 100, the entirety of the connection duct 120 may be used as a supply path of cold air, and the entirety of the extension duct 130 may be used as a collection duct of cold air. Accordingly, only ends of a portion of the branch duct 230 and a portion of the guide duct 270, which are not used as a supply path and a collection path of the sub-cabinet 200 may be sealed by caps 30.

Figure 8:
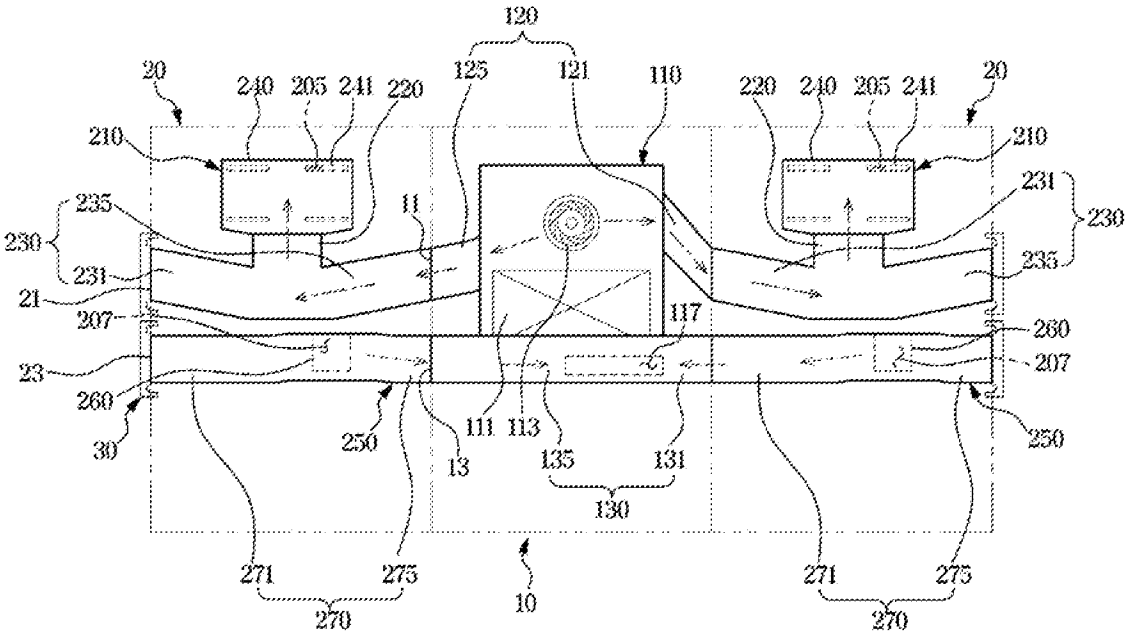
FIG. 8 is a rear view illustrating a state in which sub-cabinets are coupled to a right side and a left side of a main cabinet of a modular refrigerator according to another embodiment of the disclosure.

FIG. 8 is a rear view illustrating a state in which sub-cabinets are coupled to a right side and a left side of a main cabinet of a modular refrigerator according to another embodiment of the disclosure.

As shown in FIG. 8, a connection duct 120 may include a first connection duct 121 which extends in a right direction from a cooling unit 110 and a third connection duct 125 which extends in a left direction from the cooling unit 110. A branch duct 230 connected to the connection duct 120 may include a first branch duct 231 which branches off from a main duct 220 in a left direction of a sub-cabinet 200 and a third branch duct 235 which branches off from the main duct 220 in a right direction of the sub-cabinet 200.

An extension duct 130 may include a first extension duct 131 which extends in the right direction from the cooling unit 110 and a third extension duct 135 which extends in the left direction from the cooling unit 110. A guide duct 270 connected to the extension duct 130 may include a first guide duct 271 which branches off to guide cold air collected through a cold air collection hole 260 in the left direction of the sub-cabinet 200 and a third guide duct 275 which branches off to guide the cold air collected through the cold air collection hole 260 in the right direction of the sub-cabinet 200.

Although a configuration in which all of the connection duct 120, the branch duct 230, the extension duct 130, and the guide duct 270 branch off in only the left and right directions to have two flow paths, and a plurality of sub-cabinets 200 are connected to a left side and a right side of a main cabinet 100 is shown in the drawing, the embodiments are not limited thereto.

That is, when the connection duct 120, the branch duct 230, the extension duct 130, and the guide duct 270 branch off to have two flow paths, the sub-cabinets 200 may be coupled to the main cabinet 100 at positions corresponding to directions in which the connection duct 120, the branch duct 230, the extension duct 130, and the guide duct 270 branch off.

Figure 9:
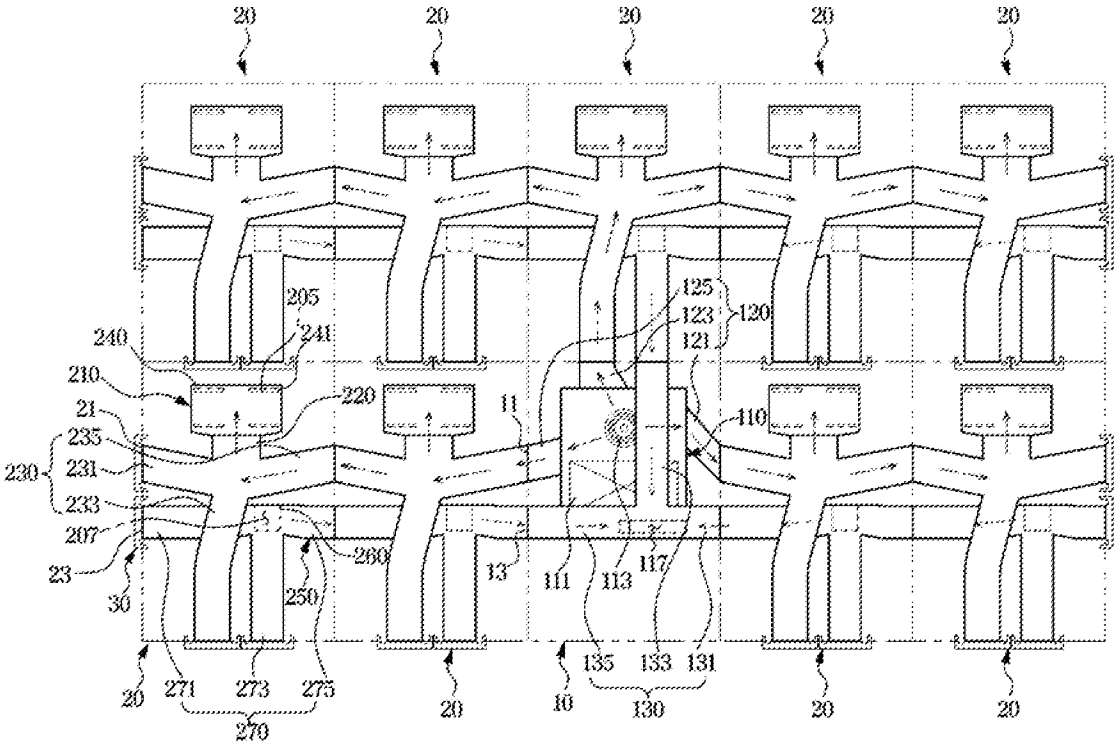
FIG. 9 is a rear view illustrating a state in which a plurality of sub-cabinets are coupled to a main cabinet of a modular refrigerator according to another embodiment of the disclosure.

FIG. 9 is a rear view illustrating a state in which a plurality of sub-cabinets are coupled to a main cabinet of a modular refrigerator according to another embodiment of the disclosure.

As shown in FIG. 9, when three or more sub-cabinets 200 are provided, three sub-cabinets 200 may be connected to right, upper, and left sides of a main cabinet 100, and the remaining sub-cabinets 200 may be coupled to right, upper, and left sides of the three sub-cabinets 200 coupled to the right, upper, and left sides of the main cabinet 100.

Figure 10:
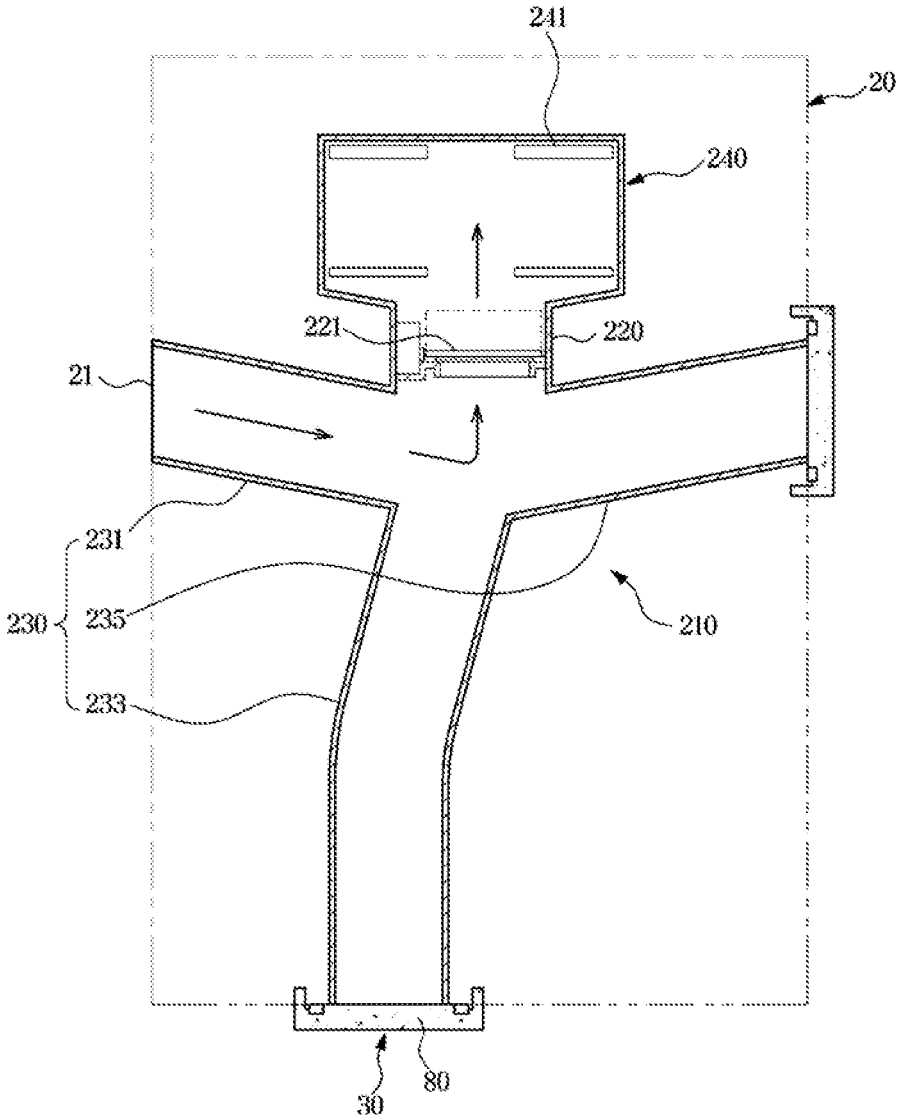
FIG. 10 is a view illustrating a state in which a damper is provided in a main duct of a cold air supply duct according to an embodiment of the disclosure.

FIG. 10 is a view illustrating a state in which a damper is provided in a main duct of a cold air supply duct according to an embodiment of the disclosure.

As shown in FIG. 10, a damper 221 for adjusting a flow rate of cold air may be provided in a main duct 220 of a cold air supply duct 210. Since a flow rate of cold air supplied to a sub-cabinet 200 from a cooling unit 110 is adjusted by the damper 221, a storage compartment 201 or 203 formed in the sub-cabinet 200 may have a different temperature from a first storage compartment 101 formed in a main cabinet 100. That is, when the first storage compartment 101 is used as a freezing compartment, the storage compartment 201 or 203 formed inside the sub-cabinet 200 may be used as a freezing compartment or a refrigerating compartment (see FIG. 2).

Figure 11:
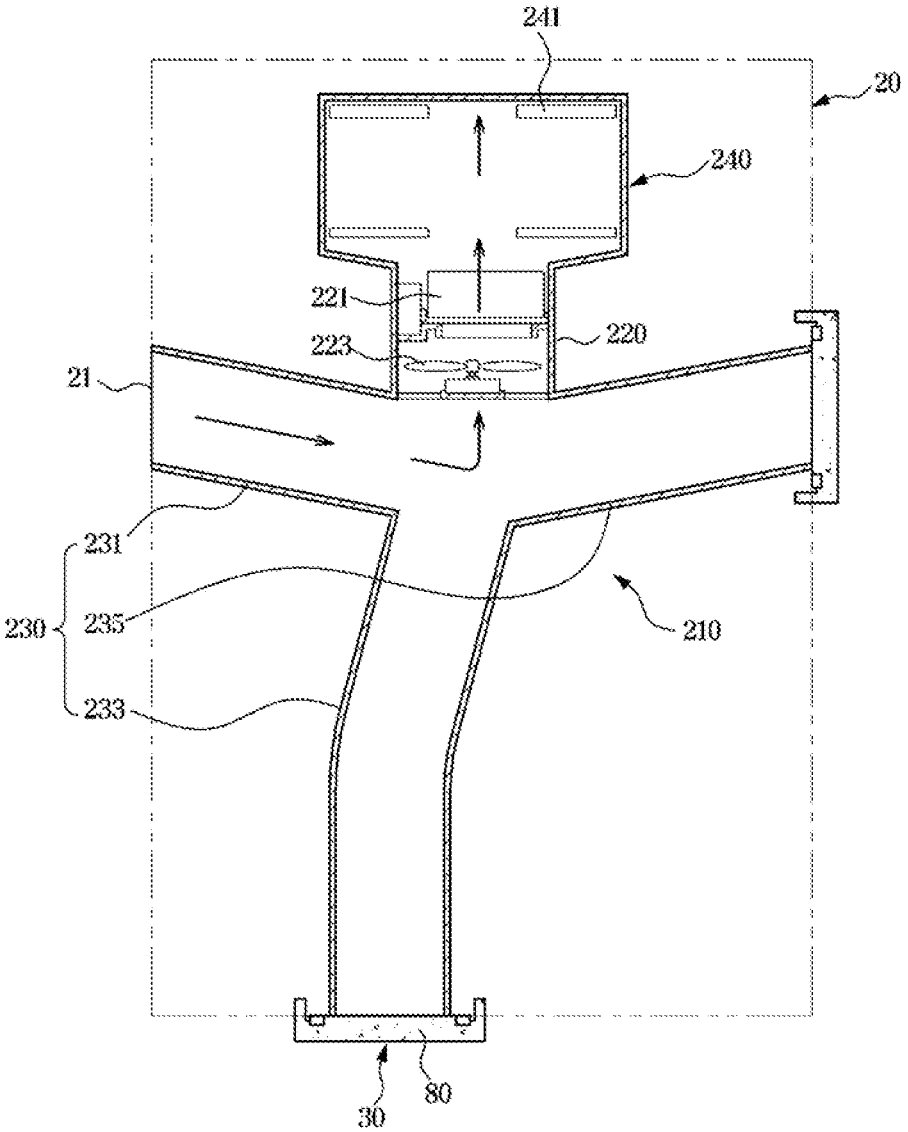
FIG. 11 is a view illustrating a state in which a damper and a fan are provided in a main duct of a cold air supply duct according to an embodiment of the disclosure.
Figure 12:
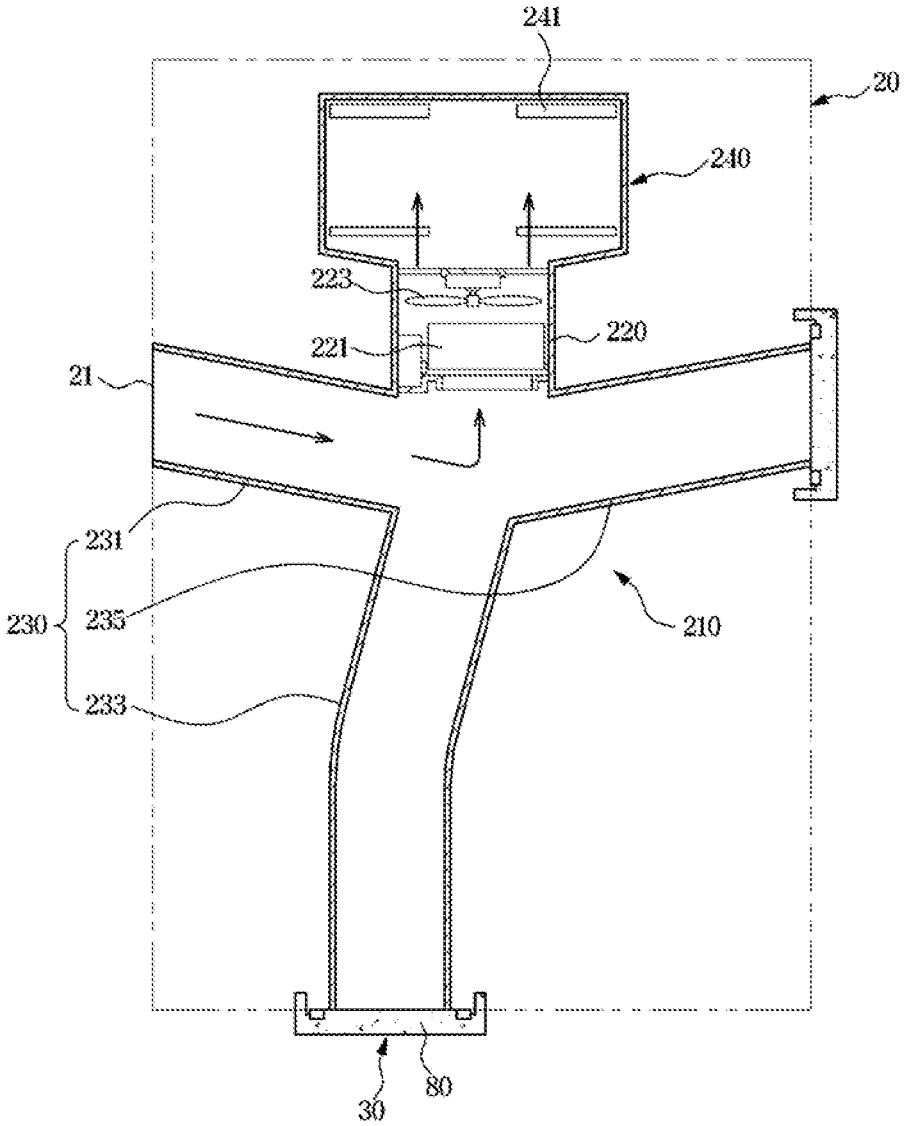
FIG. 12 is a view illustrating a state in which a damper and a fan are provided in a main duct of a cold air supply duct according to another embodiment of the disclosure.

FIG. 11 is a view illustrating a state in which a damper and a fan are provided in a main duct of a cold air supply duct according to an embodiment of the disclosure. FIG. 12 is a view illustrating a state in which a damper and a fan are provided in a main duct of a cold air supply duct according to another embodiment of the disclosure.

As shown in FIG. 11, a damper 221 for adjusting a flow rate of cold air and a fan 223 for increasing an air volume of cold air may be provided in a main duct 220 of a cold air supply duct 210. The fan 223 may be provided between the damper 221 and a branch duct 230.

As shown in FIG. 12, a fan 223 may be provided between a damper 221 and a cold air discharge duct 240.

Figure 13:
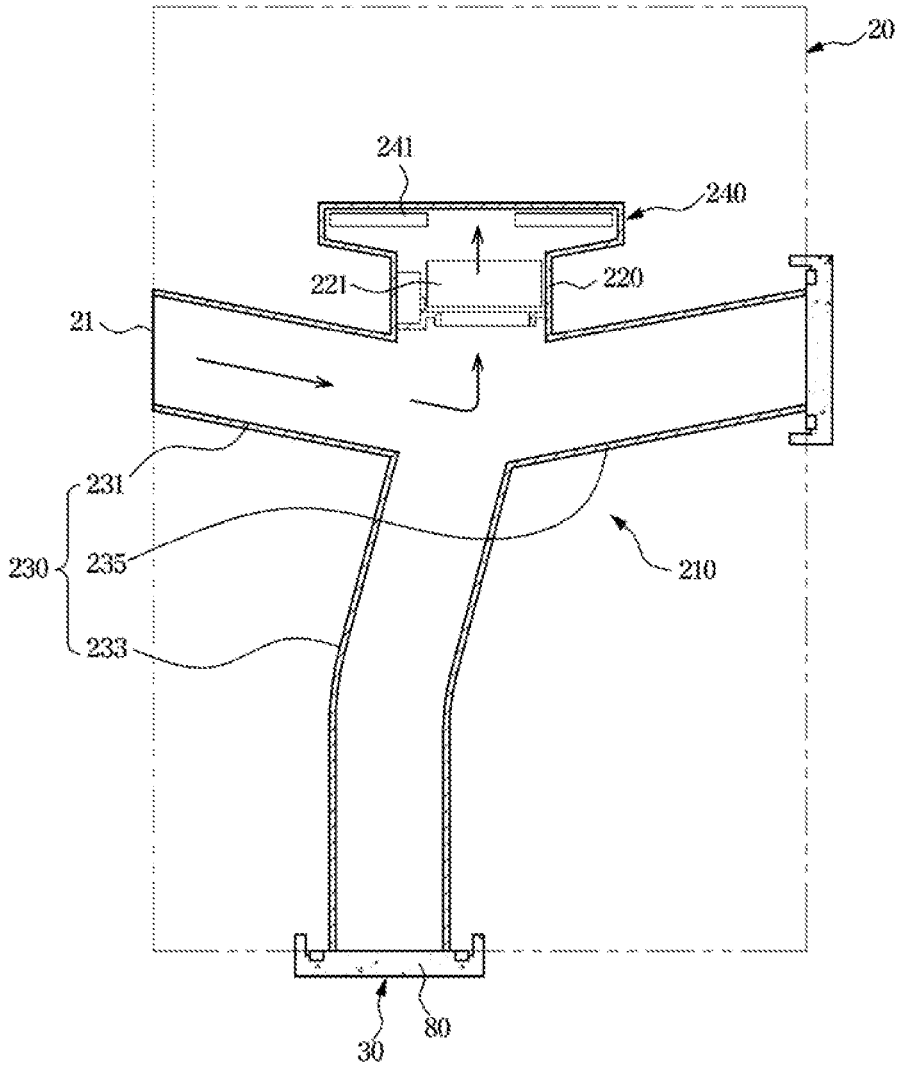
FIG. 13 is a view illustrating a state in which two cold air outlets are formed in a cold air discharge duct according to another embodiment of the disclosure.
Figure 14:
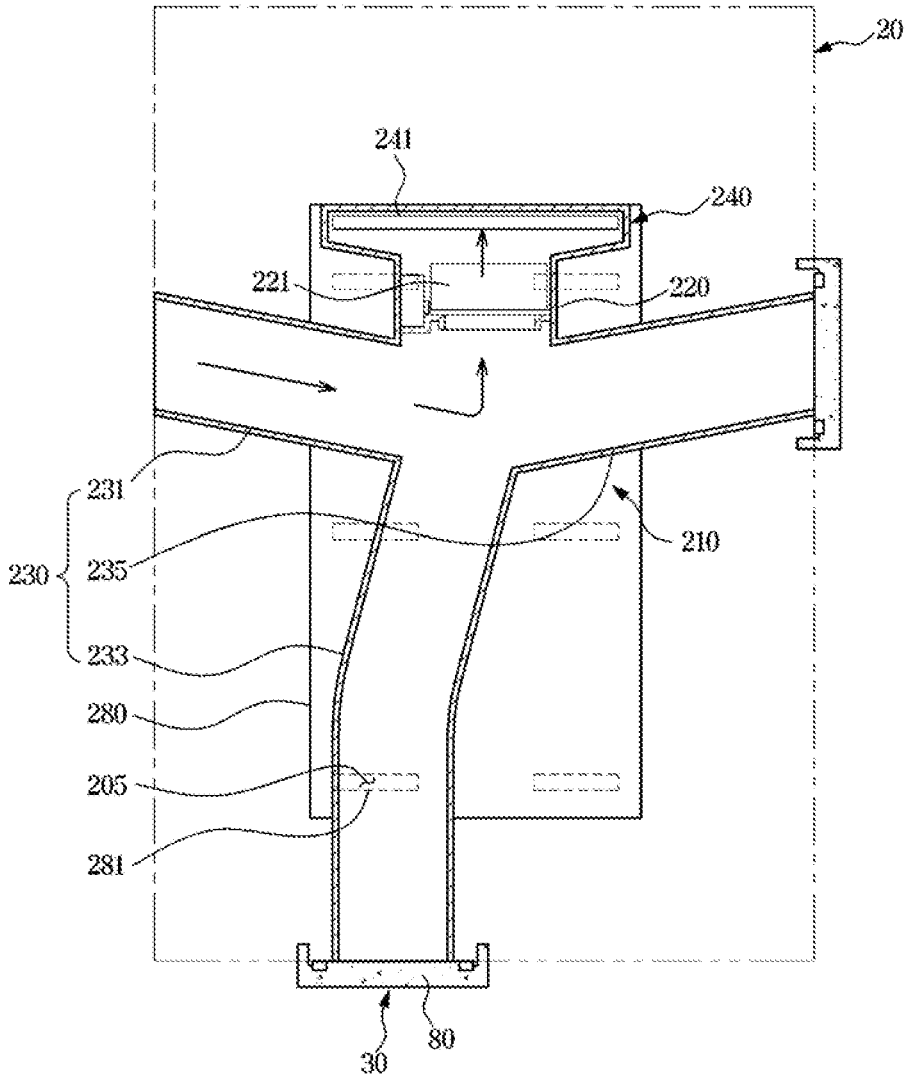
FIG. 14 is a view illustrating a state in which one cold air outlet is formed in a cold air discharge duct and the cold air outlet is connected to a multi-cold air duct according to another embodiment of the disclosure.
Figure 15:
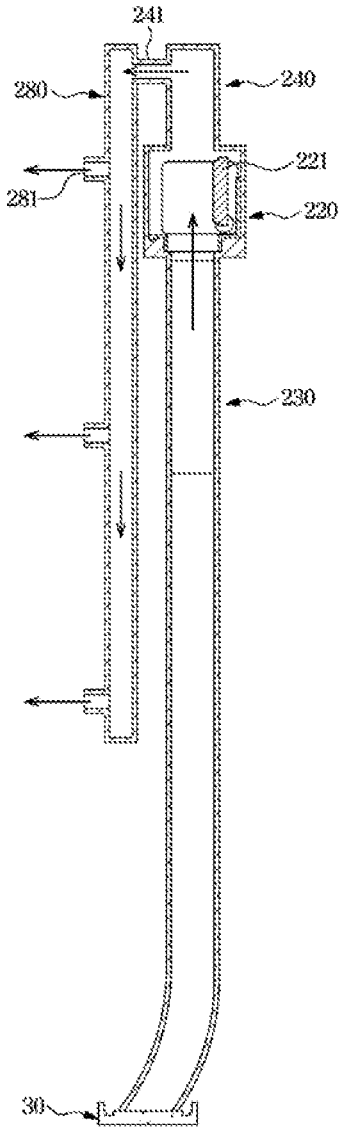
FIG. 15 is a cross-sectional view of a cold air supply duct shown in FIG. 14.

FIG. 13 is a view illustrating a state in which two cold air outlets are formed in a cold air discharge duct according to another embodiment of the disclosure. FIG. 14 is a view illustrating a state in which one cold air outlet is formed in a cold air discharge duct and the cold air outlet is connected to a multi-cold air duct according to another embodiment of the disclosure. FIG. 15 is a cross-sectional view of a cold air supply duct shown in FIG. 14.

As shown in FIG. 13, a cold air discharge duct 240 may include two cold air outlets 241.

As shown in FIGS. 14 and 15, in order for cold air to be discharged to a lower end of a storage compartment 201 or 203 formed inside a sub-cabinet 200, a multi-cold air duct 280 having a multi-cold air discharge hole 281 formed therein may be connected to a cold air discharge duct 240. The multi-cold air duct 280 allows cold air discharged through a cold air outlet 241 of the cold air discharge duct 240 to be discharged to the lower end of the storage compartment 201 or 203 through the multi-cold air discharge hole 281 (see FIG. 2).

Figure 16:
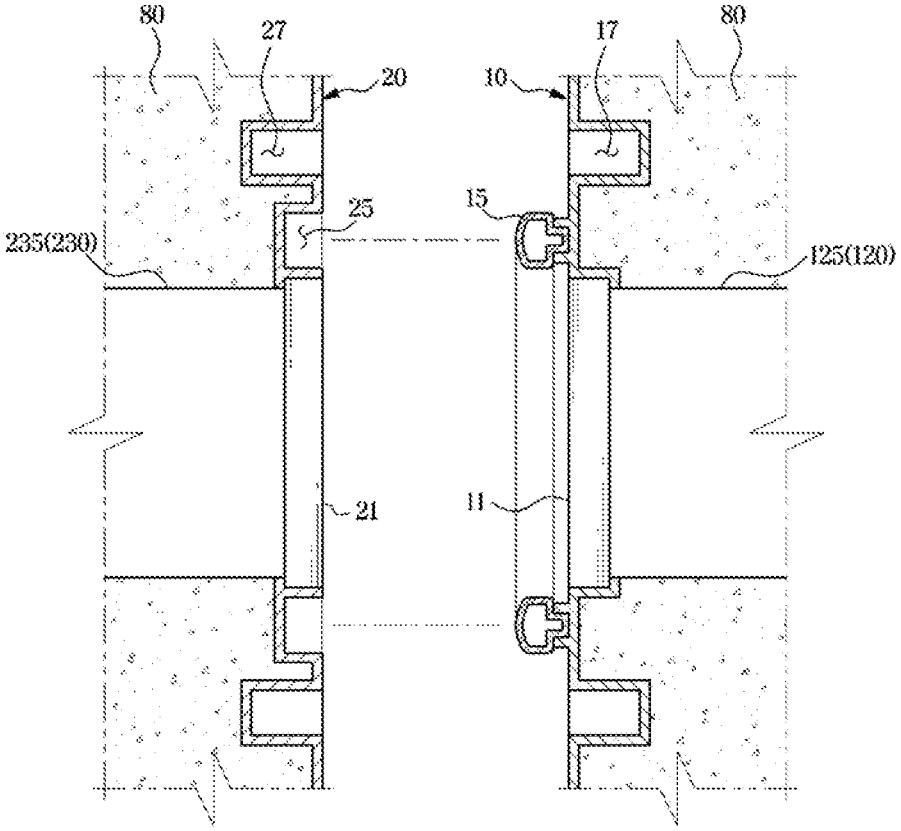
FIG. 16 is a view illustrating a state in which a connection duct and a branch duct are connected according to an embodiment of the disclosure.
Figure 17:
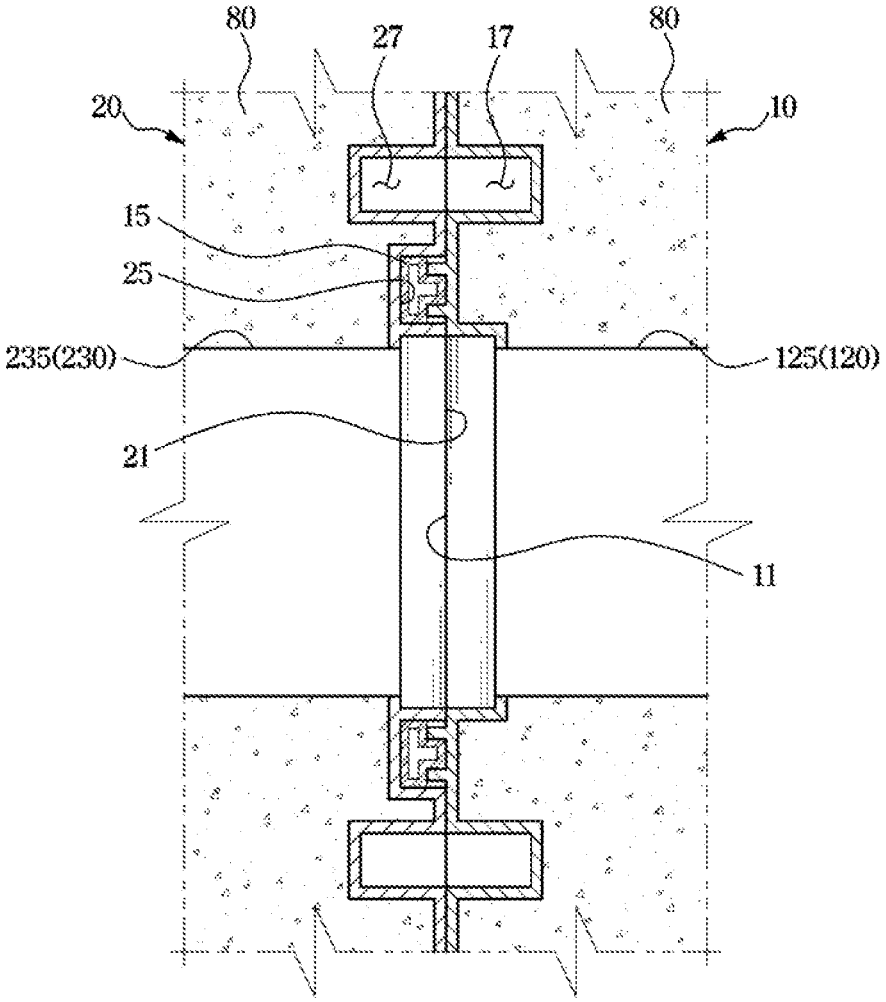
FIG. 17 is a view illustrating a state in which the connection duct and the branch duct are connected according to an embodiment of the disclosure.

FIG. 16 is a view illustrating a state in which a connection duct and a branch duct are connected according to an embodiment of the disclosure. FIG. 17 is a view illustrating a state in which the connection duct and the branch duct are connected according to an embodiment of the disclosure.

As shown in FIG. 16, a gasket 15 may be provided around a first connector 11 of a first outer box 10 at which an end of a connection duct 120 is exposed. A gasket insertion groove 25 into which the gasket 15 is inserted may be formed around a second connector 21 of a second outer box 20 at which an end of a branch duct 230 connected to the connection duct 120 is exposed.

As shown in FIG. 17, when the connection duct 120 and the branch duct 230 are connected, the gasket 15 may be inserted into the gasket insertion groove 25 so that the connection duct 120 and the branch duct 230 may be connected and sealed to prevent a leakage of cold air.

Although the drawing shows that the gasket 15 is provided in the first outer box 10 and the gasket insertion groove 25 is provided in the second outer box 20, the gasket insertion groove may be provided in the first outer box 10, and the gasket may be provided in the second outer box 20.

In addition, although the connection between the connection duct 120 and the branch duct 230 is shown in the drawing, an extension duct 130 and a guide duct 270 may also be connected and sealed in the same manner as the connection between the connection duct 120 and the branch duct 230.

Figure 18:
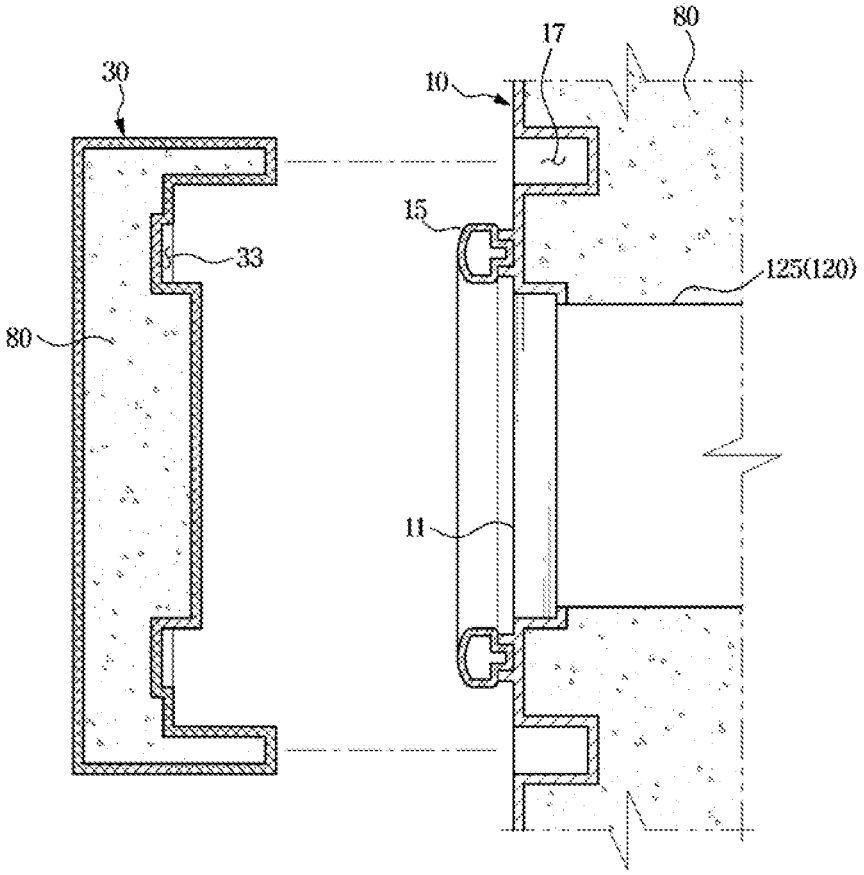
FIG. 18 is a view illustrating a state in which an end of a connection duct is sealed by a cap according to an embodiment of the disclosure.
Figure 19:
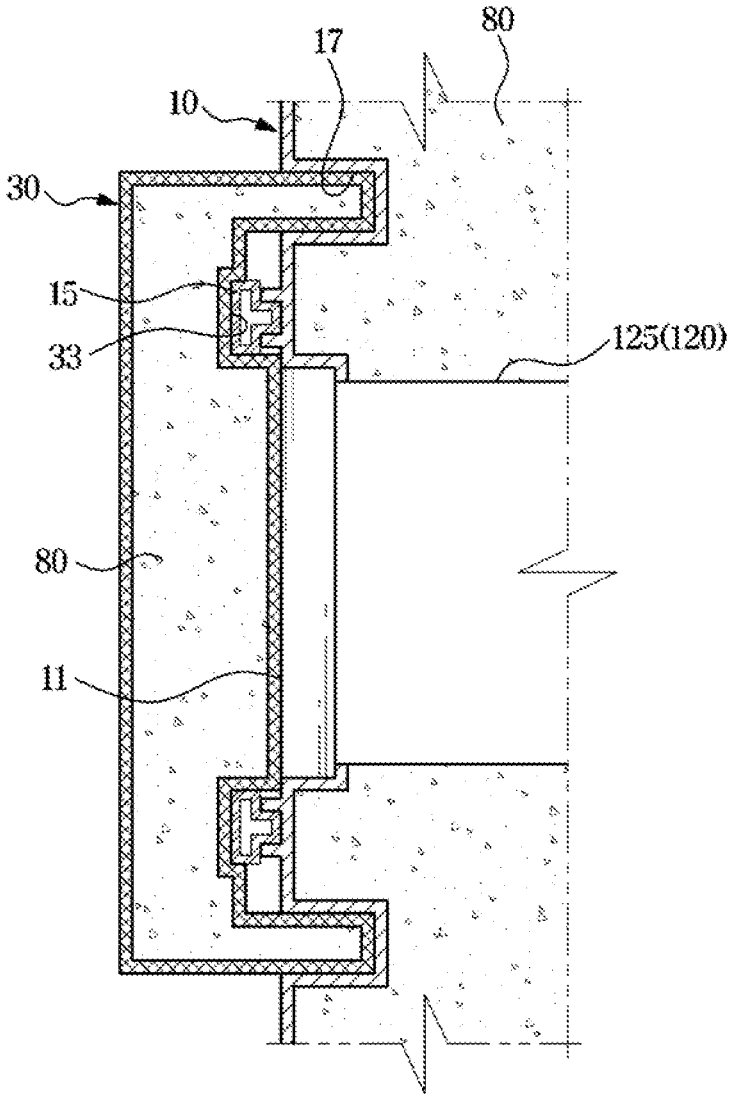
FIG. 19 is a view illustrating a state in which the end of the connection duct is sealed by the cap according to an embodiment of the disclosure.

FIG. 18 is a view illustrating a state in which an end of a connection duct is sealed by a cap according to an embodiment of the disclosure. FIG. 19 is a view illustrating a state in which the end of the connection duct is sealed by the cap according to an embodiment of the disclosure.

As shown in FIG. 18, a gasket 15 may be provided around a first connector 11 of a first outer box 10 at which an end of a connection duct 120 is exposed. An end of a portion of the connection duct 120 which is not used as a supply path of cold air may be sealed by a cap 30 to prevent a leakage of cold air. A cap coupling groove 17 may be formed in the first outer box 10 to which the cap 30 is coupled. The cap 30 may be made of an insulating material 80 such as urethane to prevent dew formation. The cap 30 may include a gasket insertion groove 33 into which the gasket 15 is inserted.

As shown in FIG. 19, when the cap 30 is coupled to the cap coupling groove 17, a space between the cap 30 and the first connector 11 may be sealed by the gasket 15 inserted into the gasket insertion groove 33 to prevent cold air from leaking to the end of the connection duct 120.

Although only a state in which the end of the connection duct 120 is sealed by the cap 30 is shown in the drawing, an end of an extension duct 130 may also be sealed by the same configuration as the above configuration.

Figure 20:
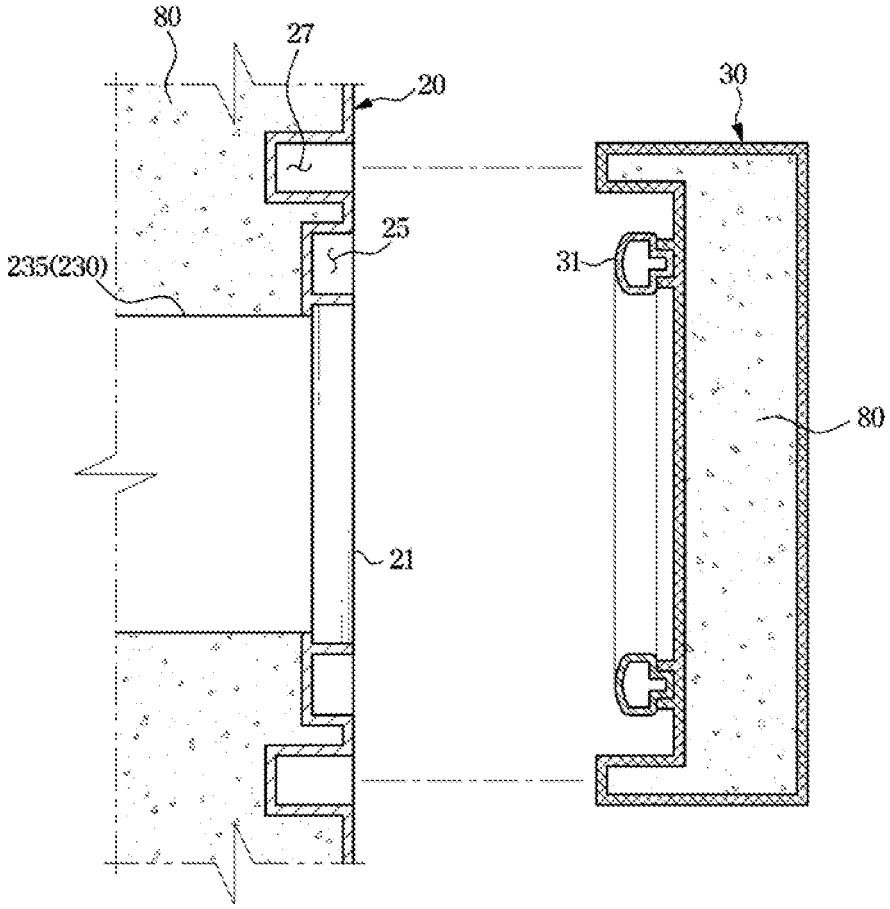
FIG. 20 is a view illustrating a state in which an end of a branch duct is sealed by a cap according to an embodiment of the disclosure.
Figure 21:
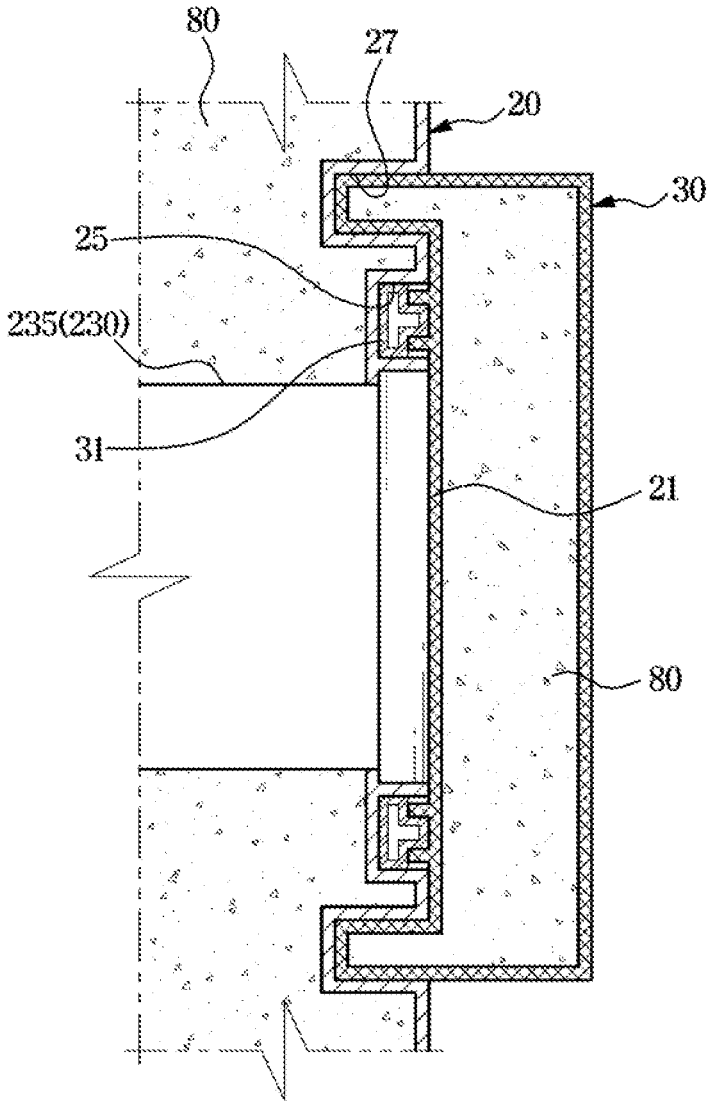
FIG. 21 is a view illustrating a state in which the end of the branch duct is sealed by the cap according to an embodiment of the disclosure.

FIG. 20 is a view illustrating a state in which an end of a branch duct is sealed by a cap according to an embodiment of the disclosure. FIG. 21 is a view illustrating a state in which the end of the branch duct is sealed by the cap according to an embodiment of the disclosure.

As shown in FIG. 20, a gasket insertion groove 25 into which a gasket 31 is inserted may be formed around a second connector 21 of a second outer box 20 at which an end of a branch duct 230 is exposed. The second outer box 20 may include a cap coupling groove 27 to which a cap 30 is coupled. The cap 30 may include a gasket 31 for sealing a space between the cap 30 and the second connector 21. Since a gasket is not provided in the second outer box 20, the gasket 31 for sealing the space between the cap 30 and the second connector 21 may be provided in the cap 30.

As shown in FIG. 21, when the cap 30 is coupled to the cap coupling groove 27, the space between the cap 30 and the second connector 21 may be sealed by the gasket 31 to prevent cold air from leaking to the end of the branch duct 230.

Although only a state in which the end of the branch duct 230 is sealed by the cap 30 is shown in the drawing, an end of a guide duct 270 may also be sealed by the same configuration as the above configuration.

Although FIGS. 18 to 21 show that the gasket 15 is provided in the first outer box 10 and the gasket is not provided in the second outer box 20, the gasket may not be provided in the first outer box 10, and the gasket may be provided in the second outer box 20.

Figure 22:
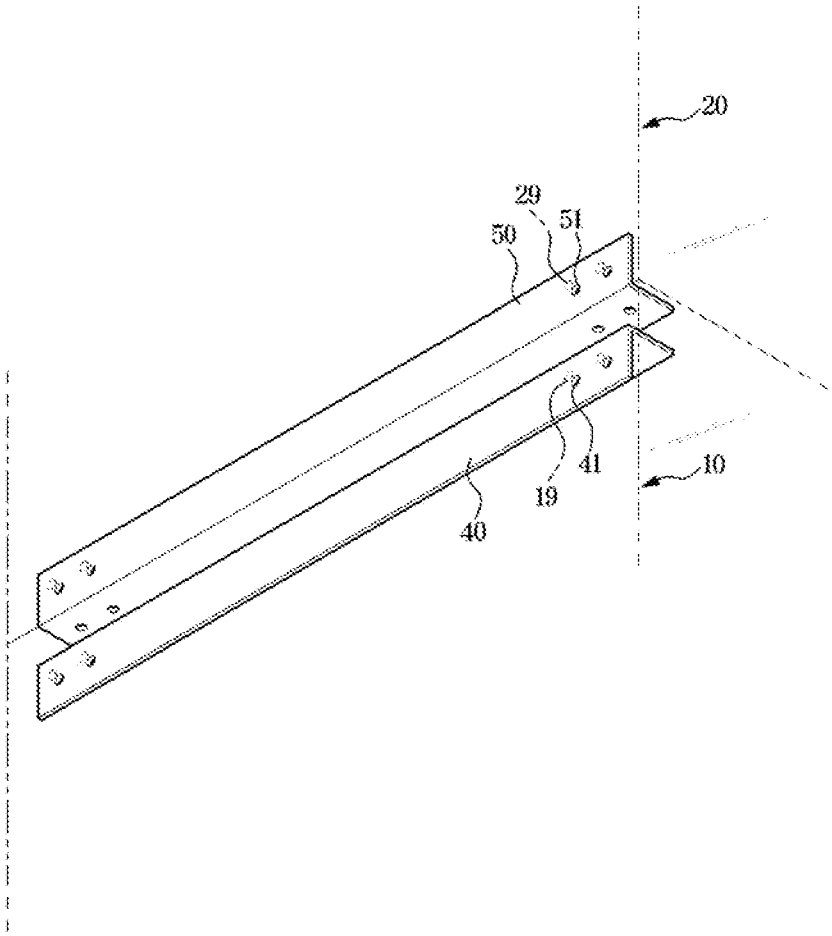
FIG. 22 is a view illustrating a state in which a first reinforcing plate and a second reinforcing plate are respectively provided inside a first outer box and a second outer box coupled to an upper side of the first outer box according to an embodiment of the disclosure.
Figure 23:
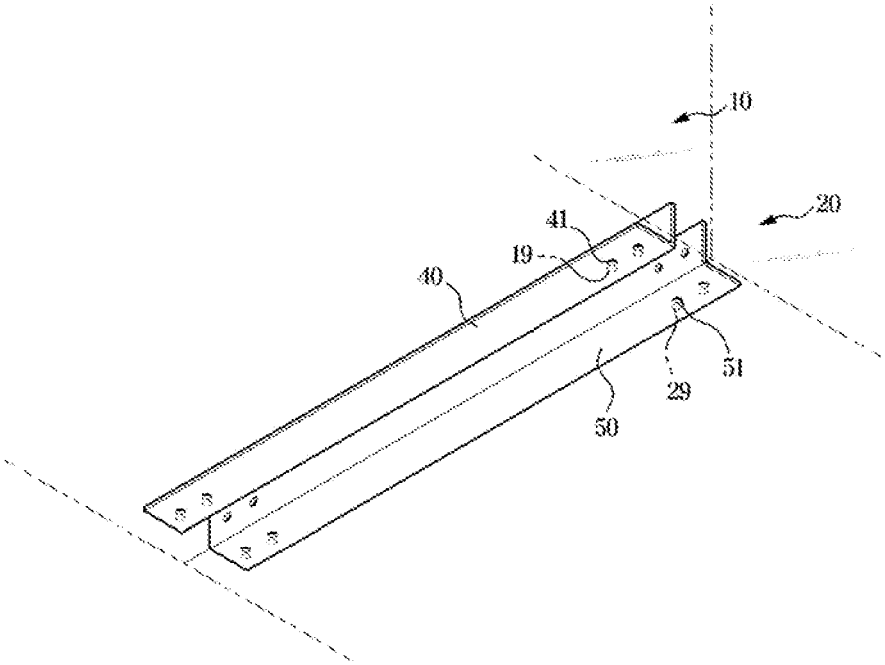
FIG. 23 is a view illustrating a state in which a first reinforcing plate and a second reinforcing plate are respectively provided inside a first outer box and a second outer box coupled to a right side of the first outer box according to an embodiment of the disclosure.
Figure 24:
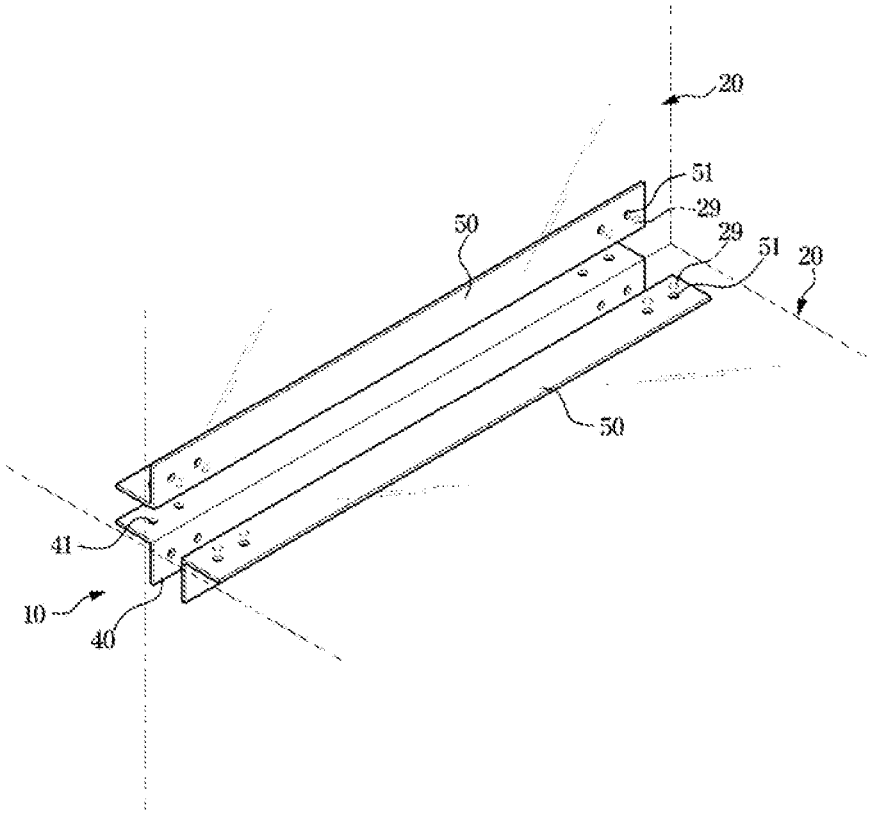
FIG. 24 is a view illustrating a state in which a first reinforcing plate and a second reinforcing plate are respectively provided inside a second outer box coupled to a right side of a first outer box and a second outer box coupled to an upper side of the first outer box according to an embodiment of the disclosure.
Figure 25:
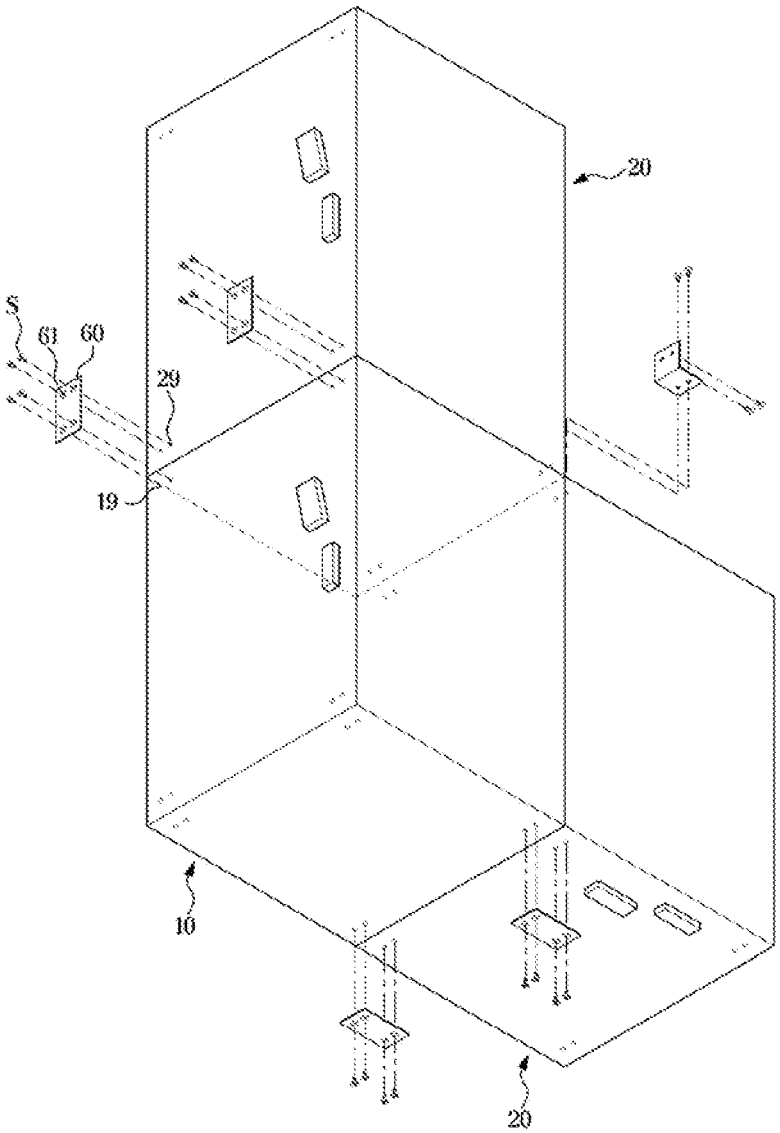
FIG. 25 is a view illustrating a state in which a first outer box and a second outer box are coupled through a bracket.

FIG. 22 is a view illustrating a state in which a first reinforcing plate and a second reinforcing plate are respectively provided inside a first outer box and a second outer box coupled to an upper side of the first outer box according to an embodiment of the disclosure. FIG. 23 is a view illustrating a state in which a first reinforcing plate and a second reinforcing plate are respectively provided inside a first outer box and a second outer box coupled to a right side of the first outer box according to an embodiment of the disclosure. FIG. 24 is a view illustrating a state in which a first reinforcing plate and a second reinforcing plate are respectively provided inside a second outer box coupled to a right side of a first outer box and a second outer box coupled to an upper side of the first outer box according to an embodiment of the disclosure. FIG. 25 is a view illustrating a state in which a first outer box and a second outer box are coupled through a bracket.

As shown in FIGS. 22 to 25, a first reinforcing plate 40 for reinforcing may be provided inside a first outer box 10. The first reinforcing plate 40 may be provided at each of left and right sides of an upper portion and a lower portion inside the first outer box 10. The first reinforcing plate 40 may include a first coupling hole 41.

A second reinforcing plate 50 for reinforcement may be provided inside a second outer box 20. The second reinforcing plate 50 may be provided at each of left and right sides of an upper portion and a lower portion inside the second outer box 20. The second reinforcing plate 50 may include a second coupling hole 51.

A third coupling hole 19 may be formed in the first outer box 10 at a position corresponding to the first coupling hole 41 of the first reinforcing plate 40. A fourth coupling hole 29 may be formed in the second outer box 20 at a position corresponding to the second coupling hole 51 of the second reinforcing plate 50.

The first outer box 10 and the second outer box 20 coupled to an upper side of the first outer box 10 may be coupled through a bracket 60 coupled to the first coupling hole 41 of the first reinforcing plate 40 provided at a left upper portion inside the first outer box 10, the third coupling hole 19 formed in the left upper portion of the first outer box 10, the second coupling hole 51 of the second reinforcing plate 50 provided at a left lower portion inside the second outer box 20, and the fourth coupling hole 29 formed in the left lower portion of the second outer box 20. The bracket 60 may be provided to have a flat plate shape. The bracket 60 may include a plurality of coupling holes 61 coupled to the first coupling hole 41, the third coupling hole 19, the second coupling hole 51, and the fourth coupling hole 29. The bracket 60 may be coupled to the first coupling hole 41, the third coupling hole 19, the second coupling hole 51, and the fourth coupling hole 29 through coupling members S inserted into the plurality of coupling holes 61. Thus, a sub-cabinet 200 may be detachably coupled to a main cabinet 100.

The first outer box 10 and the second outer box 20 coupled to a right side of the first outer box 10 may be coupled through a bracket 60 coupled to the first coupling hole 41 of the first reinforcing plate 40 provided at a right lower portion inside the first outer box 10, the third coupling hole 19 formed in the right lower portion of the first outer box 10, the second coupling hole 51 of the second reinforcing plate 50 provided at the left lower portion inside the second outer box 20, and the fourth coupling hole 29 formed in the left lower portion of the second outer box 20. The bracket 60 may be provided to have a flat plate shape.

The second outer box 20 coupled to a right side of the first outer box 10 and the second outer box 20 coupled to an upper side of the first outer box 10 may be coupled through a bracket 60 coupled to the second coupling hole 51 of the second reinforcing plate 50 provided at a left upper portion inside the second outer box 20 coupled to the right side of the first outer box 10, the fourth coupling hole 29 formed in the left upper portion of the second outer box 20, the second coupling hole 51 of the second reinforcing plate 50 provided in a right lower portion inside the second outer box 20 coupled to the upper side of the first outer box 10, and the fourth coupling hole 29 formed in the right lower portion of the second outer box 20. The bracket 60 may be provided to have an L-shape. Thus, the sub-cabinets 200 may be detachably coupled.

While specific shapes and directions have been mainly described with reference to embodiments and the accompanying drawings for the purpose of describing the modular refrigerator, the embodiments may be changed and modified by those skilled in the art, and it should be interpreted that such changes and modifications fall within the scope of the embodiments of the disclosure.

What is claimed is:

1. A modular refrigerator comprising:

a main cabinet including a cooling unit configured to generate cold air, and a connection duct that includes a first connection duct for cold air generated by the cooling unit to flow toward a right side of the main cabinet, a second connection duct for cold air generated by the cooling unit to flow toward an upper side of the main cabinet, and a third connection duct for cold air generated by the cooling unit to flow toward a left side of the main cabinet; and a sub-cabinet that is selectively coupleable to the right side of the main cabinet, the upper side of the main cabinet, and the left side of the main cabinet, and including a cold air supply duct, wherein the cold air supply duct includes:

a branch duct that branches into:

a first branch duct that, when the sub-cabinet is coupled to the right side of the main cabinet, communicates with the first connection duct to receive cold air generated by the cooling unit, a second branch duct that, when the sub-cabinet is coupled to the upper side of the main cabinet, communicates with the second connection duct to receive cold air generated by the cooling unit, a third branch duct that, when the sub-cabinet is coupled to the left side of the main cabinet, communicates with third connection duct to receive cold air generated by the cooling unit, and a cold air discharge duct through which at least some of the air received by the branch duct is discharged into the sub-cabinet.

2. The modular refrigerator of claim 1, wherein the cold air supply duct includes: a main duct above the branch duct-, and the cold air discharge duct is connected to an upper portion of the main duct, so that cold air generated by the cooling unit is flowable through the branch duct, then through the main duct, and then through the cold air discharge duct to be discharged to a storage compartment inside the sub-cabinet.

3. The modular refrigerator of claim 2, wherein the first branch duct branches off from the main duct in a left direction of the sub-cabinet, the second branch duct branches off from the main duct in a lower direction of the sub-cabinet, and the third branch duct branches off from the main duct in a right direction of the sub-cabinet.

4. The modular refrigerator of claim 3, wherein:

the main cabinet includes a connection duct extending from the cooling unit and connected to the branch duct, and the connection duct includes the first connection duct extending in a right direction from the cooling unit, the second connection duct extending in an upper direction from the cooling unit, and the third connection duct extending in a left direction from the cooling unit.

5. The modular refrigerator of claim 4, wherein, when the sub-cabinet is coupled to the right side of the main cabinet, the first connection duct and the first branch duct are connected so that cold air generated by the cooling unit is supplied to the sub-cabinet.

6. The modular refrigerator of claim 4, wherein, when the sub-cabinet is coupled to the upper side of the main cabinet, the second connection duct and the second branch duct are connected so that cold air generated by the cooling unit is supplied to the sub-cabinet.

7. The modular refrigerator of claim 4, wherein, when the sub-cabinet is coupled to the left side of the main cabinet, the third connection duct and the third branch duct are connected so that cold air generated by the cooling unit is supplied to the sub-cabinet.

8. The modular refrigerator of claim 2, wherein the main duct includes a damper configured to adjust a flow rate of cold air generated by the cooling unit and flowing through the main duct.

9. The modular refrigerator of claim 8, wherein:

the main duct further includes a fan between the damper and the cold air discharge duct, the fan configured to increase an air volume of cold air generated by the cooling unit and flowing through the main duct.

10. The modular refrigerator of claim 8, wherein:

the main duct further includes a fan between the damper and the branch duct, the fan configured to increase an air volume of cold air generated by the cooling unit and flowing through the main duct.

11. The modular refrigerator of claim 2, wherein:

the cold air discharge duct includes a cold air outlet, and the sub-cabinet includes a cold air discharge hole formed at a position corresponding to a position of the cold air outlet, so that cold air flowing through the cold air discharge duct is discharged from the cold air discharge duct through the cold air outlet and then through the cold air discharge hole into the storage compartment.

12. The modular refrigerator of claim 2, wherein the sub-cabinet further includes a cold air collection duct to collect cold air from the storage compartment and guide the collected cold air to the cooling unit.

13. The modular refrigerator of claim 12, wherein the cold air collection duct includes:

a cold air collection hole through which the cold air from the storage compartment is collected, and a guide duct which guides the cold air collected through the cold air collection hole toward the cooling unit, and the guide duct includes:

a first guide duct which branches off in a left direction of the sub-cabinet so that, when the sub-cabinet is coupled to the right side of the main cabinet, the first guide duct guides the cold air collected through the cold air collection hole toward the cooling unit, a second guide duct which branches off in a lower direction of the sub-cabinet so that, when the sub-cabinet is coupled to the upper side of the main cabinet, the second guide duct guides the cold air collected through the cold air collection hole toward the cooling unit, and a third guide duct which branches off in a right direction of the sub-cabinet so that, when the sub-cabinet is coupled to the left side of the main cabinet, the third guide duct guides the cold air collected through the cold air collection hole toward the cooling unit.

14. The modular refrigerator of claim 13, wherein:

the main cabinet includes an extension duct extending from a communication hole of the cooling unit and connected to the guide duct, and the extension duct includes:

a first extension duct extending in a right direction from the cooling unit and, when the sub-cabinet is coupled to the right side of the main cabinet, connects to the first guide duct of the sub-cabinet, a second extension duct extending in an upper direction from the cooling unit and, when the sub-cabinet is coupled to the upper side of the main cabinet, connects to the second guide duct of the sub-cabinet, and a third extension duct extending in a left direction from the cooling unit and, when the sub-cabinet is coupled to the left side of the main cabinet, connects to the third guide duct of the sub-cabinet.

15. The modular refrigerator of claim 13, further comprising:

caps configured to, when the sub-cabinet is coupled to one of the right side of the main body, the upper side of the body, and the left side of the main body, seal portions of the branch duct and the connection duct not connected to each other and portions of the guide duct and the extension duct not connected to each other, to prevent a leakage of cold air.

* * * * *